US010831118B2

(12) United States Patent
Watanabe et al.

(10) Patent No.: US 10,831,118 B2
(45) Date of Patent: Nov. 10, 2020

(54) ELECTROPHOTOGRAPHIC PHOTOSENSITIVE MEMBER AND METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Hiroyuki Watanabe, Suntou-gun (JP); Tsutomu Nishida, Mishima (JP); Yuka Ishiduka, Suntou-gun (JP); Atsushi Okuda, Yokohama (JP); Hideharu Shimozawa, Numazu (JP); Nobuhiro Nakamura, Numazu (JP); Koichi Nakata, Tokyo (JP); Haruki Mori, Ichikawa (JP); Kenichi Kaku, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/423,418

(22) Filed: May 28, 2019

(65) Prior Publication Data

US 2019/0369514 A1 Dec. 5, 2019

(30) Foreign Application Priority Data

May 31, 2018 (JP) ..... 2018-105585

(51) Int. Cl.

| | |
|---|---|
| ***G03G 5/00*** | (2006.01) |
| ***G03G 5/147*** | (2006.01) |
| ***G03G 5/06*** | (2006.01) |

(52) U.S. Cl.

CPC ..... *G03G 5/14708* (2013.01); *G03G 5/0614* (2013.01)

(58) Field of Classification Search

CPC ..... G03G 5/14708; G03G 5/0614

(Continued)

(56) References Cited

U.S. PATENT DOCUMENTS

| | | |
|---|---|---|
| 6,991,881 B2 | 1/2006 | Ogaki et al. |
| 6,994,941 B2 | 2/2006 | Tanaka et al. |

(Continued)

FOREIGN PATENT DOCUMENTS

| | | |
|---|---|---|
| JP | 2005-062300 | 3/2005 |
| JP | 2005-062302 | 3/2005 |

OTHER PUBLICATIONS

U.S. Appl. No. 16/423,326, Hiroyuki Watanabe, filed May 28, 2019.

(Continued)

*Primary Examiner* — Mark A Chapman

(74) *Attorney, Agent, or Firm* — Venable LLP

(57) ABSTRACT

A method for producing an electrophotographic photosensitive member having a photosensitive layer and a protective layer above a support in this order includes: forming a coating film for a protective layer by coating a coating liquid for the protective layer for forming the protective layer on the photosensitive layer and curing the coating film for the protective layer, in which the coating liquid for the protective layer contains a solvent, a compound represented by a general formula (1), a compound represented by a general formula (2), and a compound represented by a general formula (3) at a specific ratio. In addition, in an electrophotographic photosensitive member having a photosensitive layer and a protective layer above a support in this order, the protective layer is obtained by curing a coating liquid for the protective layer.

7 Claims, 1 Drawing Sheet

(58) Field of Classification Search
USPC ..... 430/132
See application file for complete search history.

(56) References Cited

U.S. PATENT DOCUMENTS

| | | | | |
|---|---|---|---|---|
| 7,001,699 | B2 | 2/2006 | Tanaka et al. | |
| 7,045,261 | B2 | 5/2006 | Tanaka et al. | |
| 7,186,489 | B2 | 3/2007 | Uematsu et al. | |
| 7,226,711 | B2 | 6/2007 | Amamiya et al. | |
| 7,534,534 | B2 | 5/2009 | Nakata et al. | |
| 7,585,604 | B2 | 9/2009 | Ogaki et al. | |
| 7,645,547 | B2 | 1/2010 | Okuda et al. | |
| 7,655,370 | B2 | 2/2010 | Kitamura et al. | |
| 7,910,274 | B2 | 3/2011 | Tanaka et al. | |
| 7,927,774 | B2 | 4/2011 | Ogaki et al. | |
| 8,088,541 | B2 | 1/2012 | Tanaka et al. | |
| 8,455,170 | B2 | 6/2013 | Nakamura et al. | |
| 8,481,236 | B2 | 7/2013 | Tanaka et al. | |
| 8,632,935 | B2 | 1/2014 | Sugiyama et al. | |
| 8,669,027 | B2 | 3/2014 | Anezaki et al. | |
| 8,753,789 | B2 | 6/2014 | Ogaki et al. | |
| 8,765,335 | B2 | 7/2014 | Tanaka et al. | |
| 8,783,209 | B2 | 7/2014 | Kaku et al. | |
| 8,815,479 | B2 | 8/2014 | Shida et al. | |
| 8,846,281 | B2 | 9/2014 | Okuda et al. | |
| 8,865,381 | B2 | 10/2014 | Tanaka et al. | |
| 8,921,020 | B2 | 12/2014 | Murai et al. | |
| 8,980,508 | B2 | 3/2015 | Okuda et al. | |
| 8,980,509 | B2 | 3/2015 | Noguchi et al. | |
| 9,029,054 | B2 | 5/2015 | Okuda et al. | |
| 9,040,214 | B2 | 5/2015 | Fujii et al. | |
| 9,046,797 | B2 | 6/2015 | Fujii et al. | |
| 9,063,505 | B2 | 6/2015 | Sekiya et al. | |
| 9,069,267 | B2 | 6/2015 | Kaku et al. | |
| 9,114,565 | B2 | 8/2015 | Kawai et al. | |
| 9,170,506 | B2 | 10/2015 | Tanaka et al. | |
| 9,170,507 | B2 | 10/2015 | Sugiyama et al. | |
| 9,188,888 | B2 | 11/2015 | Okuda et al. | |
| 9,207,550 | B2 | 12/2015 | Okuda et al. | |
| 9,280,071 | B2 | 3/2016 | Maruyama et al. | |
| 9,280,072 | B2 | 3/2016 | Ogaki et al. | |
| 9,280,073 | B1 * | 3/2016 | Tada | G03G 5/04 |
| 9,282,615 | B2 | 3/2016 | Yamagishi et al. | |
| 9,304,416 | B2 | 4/2016 | Noguchi et al. | |
| 9,316,931 | B2 | 4/2016 | Takagi et al. | |
| 9,341,964 | B2 | 5/2016 | Ogaki et al. | |
| 9,372,417 | B2 | 6/2016 | Fujii et al. | |
| 9,372,418 | B2 | 6/2016 | Shida et al. | |
| 9,372,419 | B2 | 6/2016 | Tsuji et al. | |
| 9,389,523 | B2 | 7/2016 | Nakata et al. | |
| 9,436,106 | B2 | 9/2016 | Kuno et al. | |
| 9,436,107 | B2 | 9/2016 | Murakami et al. | |
| 9,459,545 | B2 | 10/2016 | Tanaka et al. | |
| 9,523,929 | B2 | 12/2016 | Nakamura et al. | |
| 9,535,346 | B2 | 1/2017 | Sekiya et al. | |
| 9,541,850 | B2 | 1/2017 | Nishida et al. | |
| 9,563,139 | B2 | 2/2017 | Kawahara et al. | |
| 9,575,422 | B2 | 2/2017 | Okuda et al. | |
| 9,594,318 | B2 | 3/2017 | Nakata et al. | |
| 9,599,915 | B2 | 3/2017 | Anezaki et al. | |
| 9,599,917 | B2 | 3/2017 | Okuda et al. | |
| 9,645,515 | B2 | 5/2017 | Kuno et al. | |
| 9,645,516 | B2 | 5/2017 | Kawahara et al. | |
| 9,684,277 | B2 | 6/2017 | Yamamoto et al. | |
| 9,726,992 | B2 | 8/2017 | Sakuma et al. | |
| 9,740,117 | B2 | 8/2017 | Kosaka et al. | |
| 9,772,596 | B2 | 9/2017 | Mitsui et al. | |
| 9,791,792 | B2 | 10/2017 | Miyauchi et al. | |
| 9,869,032 | B2 | 1/2018 | Kawahara et al. | |
| 10,042,272 | B2 | 8/2018 | Mori et al. | |
| 10,073,362 | B2 | 9/2018 | Fujii et al. | |
| 10,120,331 | B2 | 11/2018 | Nakata et al. | |
| 10,162,278 | B2 | 12/2018 | Kuno et al. | |
| 10,203,617 | B2 | 2/2019 | Kuno et al. | |
| 10,303,085 | B2 | 5/2019 | Sato et al. | |
| 10,310,395 | B2 | 6/2019 | Nakata et al. | |
| 2010/0119260 | A1 * | 5/2010 | Egawa | G03G 5/075 399/159 |
| 2014/0004450 | A1 | 1/2014 | Tokimitsu et al. | |
| 2014/0093281 | A1 | 4/2014 | Takahashi et al. | |
| 2015/0185630 | A1 | 7/2015 | Ito et al. | |
| 2015/0185634 | A1 | 7/2015 | Sekiya et al. | |
| 2015/0316863 | A1 | 11/2015 | Tanaka et al. | |
| 2015/0346617 | A1 | 12/2015 | Kawahara et al. | |
| 2015/0362847 | A1 | 12/2015 | Tanaka et al. | |
| 2016/0091807 | A1 | 3/2016 | Tanaka et al. | |
| 2016/0131985 | A1 | 5/2016 | Tanaka et al. | |
| 2017/0060008 | A1 | 3/2017 | Okuda et al. | |
| 2018/0059558 | A1 | 3/2018 | Ito et al. | |
| 2018/0329317 | A1 | 11/2018 | Mori et al. | |
| 2018/0335708 | A1 | 11/2018 | Nakata et al. | |
| 2018/0341190 | A1 | 11/2018 | Nishi et al. | |
| 2019/0049867 | A1 | 2/2019 | Tokimitsu et al. | |
| 2019/0056676 | A1 | 2/2019 | Nakata et al. | |
| 2019/0094726 | A1 | 3/2019 | Mori et al. | |

OTHER PUBLICATIONS

U.S. Appl. No. 16/423,337, Yuka Ishiduka, filed May 28, 2019.
U.S. Appl. No. 16/423,381, Atsushi Okuda, filed May 28, 2019.
U.S. Appl. No. 16/423,393, Tsutomu Nishida, filed May 28, 2019.
U.S. Appl. No. 16/423,429, Nobuhiro Nakamura, filed May 28, 2019.
U.S. Appl. No. 16/272,268, Hideharu Shimozawa, filed Feb. 11, 2019.
U.S. Appl. No. 16/286,762, Nobuhiro Nakamura, filed Feb. 27, 2019.
U.S. Appl. No. 16/287,102, Tsutomu Nishida, filed Feb. 27, 2019.
U.S. Appl. No. 16/416,929, Haruki Mori, filed May 20, 2019.
U.S. Appl. No. 16/423,292, Yasutaka Yagi, filed May 28, 2019.
U.S. Appl. No. 16/430,860, Koichi Nakata, filed Jun. 4, 2019.

* cited by examiner

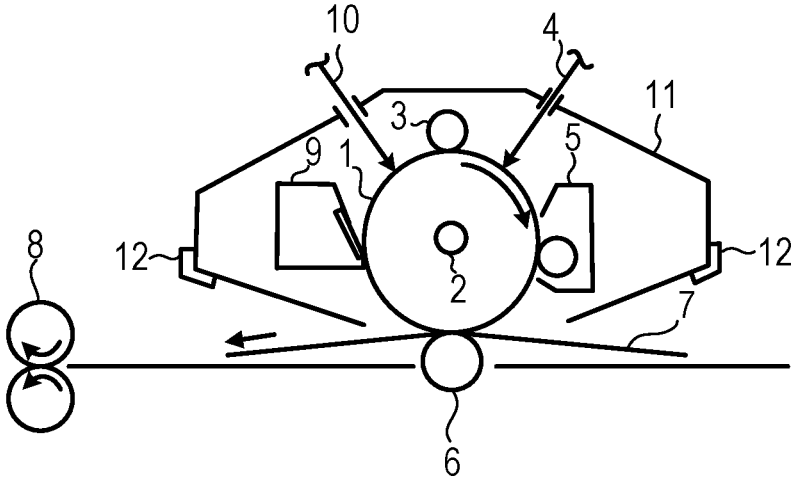
10
4
11
3
9
1
5
8
12
2
12
7
6

ELECTROPHOTOGRAPHIC PHOTOSENSITIVE MEMBER AND METHOD FOR PRODUCING ELECTROPHOTOGRAPHIC PHOTOSENSITIVE MEMBER

BACKGROUND OF THE INVENTION

Field of the Invention

The present invention relates to an electrophotographic photosensitive member and a method for producing an electrophotographic photosensitive member.

Description of the Related Art

An electrophotographic photosensitive member having a photosensitive layer above a support is used as an electrophotographic photosensitive member (hereinafter, also referred to as a photosensitive member) used in an electrophotographic apparatus. It is hard to say that a mechanical strength of a surface of a photosensitive layer of the conventional electrophotographic photosensitive member is sufficient for the recent demand for higher image quality and longer life. In order to solve this problem, a technique is disclosed in which films obtained by curing a compound having a polymerizable functional group in the same molecule is laminated on a photosensitive layer as a protective layer (for example, Japanese Patent Application Laid-Open No. 2005-62302). In such an electrophotographic photosensitive member, in order to form a uniform image, it is required to uniformly apply a coating liquid for forming the protective layer (to make a film thickness uniform). Generally, as a coating method, there is a dip coating method which forms a coating film by dipping a cylindrical substrate in a coating liquid and pulling up the cylindrical substrate. However, in this dip coating method, unevenness of a film thickness of the protective layer may occur due to stagnation of the coating liquid in a coating process, solvent volatilization in touch drying and a drying process, or the solvent volatilization at the time of peeling a lower end region of the photosensitive member. Since the unevenness of the film thickness appears as image unevenness at the time of image output when the unevenness of the film thickness is large, in particular, it is important to eliminate the unevenness of the film thickness of the protective layer located on the outermost surface of the photosensitive member.

Japanese Patent Application Laid-Open No. 2005-62302 discloses a photosensitive member which is excellent in a mechanical strength and electrophotographic properties by using a cured film of a mixture of a charge transporting compound having a polymerizable functional group and a charge transporting compound having a hydroxyl group as the outermost layer.

Japanese Patent Application Laid-Open No. 2005-62300 discloses a photosensitive member which is excellent in a mechanical strength and electrophotographic properties by applying a cured film of a mixture of a charge transporting compound having a polymerizable functional group and a compound having a hydroxyl group to a surface of a photosensitive layer.

SUMMARY OF THE INVENTION

According to the studies of the present inventors, it was found that in the electrophotographic photosensitive members described in Japanese Patent Application Laid-Open No. 2005-62302 and Japanese Patent Application Laid-Open No. 2005-62300, the image unevenness may occur due to the unevenness of the film thickness of the protective layer.

Accordingly, an object of the present invention is to provide an electrophotographic photosensitive member capable of suppressing occurrence of image unevenness due to unevenness of a film thickness of a protective layer and has excellent abrasion resistance, and a method for producing an electrophotographic photosensitive member.

The above object is achieved by the present invention described below. That is, a method for producing an electrophotographic photosensitive member according to an aspect of the present invention is a method for producing an electrophotographic photosensitive member having a photosensitive layer and a protective layer above a support in this order, and the method for producing an electrophotographic photosensitive member includes forming a coating film for a protective layer by coating a coating liquid for the protective layer for forming the protective layer on the photosensitive layer and curing the coating film for the protective layer, in which the coating liquid for the protective layer contains a solvent, a compound represented by the following general formula (1), a compound represented by the following general formula (2), and a compound represented by the following general formula (3), and a content of the compound represented by the following general formula (2) is 0.001 mass % or more and 5.0 mass % or less and a content of the compound represented by the following general formula (3) is 0.001 mass % or more and 5.0 mass % or less with respect to the content of the compound represented by the following general formula (1).

(1)

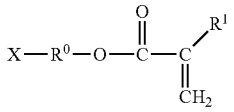

($R^0$ represents a single bond, a substituted or unsubstituted alkylene group, or a substituted or unsubstituted phenylene group, and when $R^0$ is an alkylene group, the number of carbon atoms is 2 or more and 5 or less, and as the substituent in the case where the alkylene group or the phenylene group has a substituent, a hydrogen atom, a methyl group, or an ethyl group is preferable, and the hydrogen atom is particularly preferable. $R^1$ represents a hydrogen atom or a methyl group, and X represents a charge transport site.)

(2)

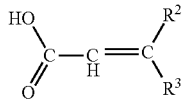

($R^2$ and $R^3$ each represent a hydrogen atom or a methyl group independently.)

(3)

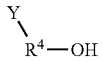

($R^4$ represents a single bond, a substituted or unsubstituted alkylene group, or a substituted or unsubstituted phenylene group, and when $R^4$ is an alkylene group, the number of carbon atoms is 2 to 5, and when $R^4$ has a substituent, as the substituent, a hydrogen atom, a methyl group, or an ethyl group is preferable, and the hydrogen atom is particularly preferable and Y represents a charge transport site.)

In addition, an electrophotographic photosensitive member according to an aspect of the present invention is an electrophotographic photosensitive member having a photosensitive layer and a protective layer above a support in this order, in which the protective layer is a film obtained by curing a coating film for a protective layer, the coating liquid for the protective layer contains a solvent, a compound represented by the following general formula (1), a compound represented by the following general formula (2), and a compound represented by the following general formula (3), a content of the compound represented by the following general formula (2) is 0.001 mass % or more and 5.0 mass % or less, and a content of the compound represented by the following general formula (3) is 0.001 mass % or more and 5.0 mass % or less with respect to the content of the compound represented by the following general formula (1).

Further features of the present invention will become apparent from the following description of exemplary embodiments with reference to the attached drawing.

BRIEF DESCRIPTION OF THE DRAWINGS

FIGURE is a diagram showing an example of a schematic configuration of an electrophotographic apparatus having a process cartridge provided with an electrophotographic photosensitive member.

DESCRIPTION OF THE EMBODIMENTS

Hereinafter, the present invention will be described in detail with reference to preferred embodiments.

As the conventional technology, there has been known a photosensitive member having a surface layer formed by using a coating liquid containing only a compound represented by the above general formula (1) and a compound represented by the above general formula (3) among the compound represented by the above general formula (1), a compound represented by the above general formula (2), and the compound represented by the above general formula (3). However, as a result of repeated studies by the present inventors, it was found that in the photosensitive member of the related art, there is a possibility that image unevenness may occur due to unevenness of a film thickness of the protective layer.

The inventors investigated a type of material and a ratio thereof in order to solve the technical problems that occurred in the above-mentioned related art. As a result of the investigation, it has been found that the occurrence of the image unevenness due to the unevenness of the film thickness of the protective layer is suppressed by using a method for producing an electrophotographic photosensitive member and an electrophotographic photosensitive member produced by the production method which will be described below.

That is, the method for producing an electrophotographic photosensitive member according to an aspect of the present invention is a method for producing an electrophotographic photosensitive member having a photosensitive layer and a protective layer above a support in this order. The method for producing an electrophotographic photosensitive member includes forming a coating film for a protective layer by coating a coating liquid for the protective layer for forming the protective layer on the photosensitive layer and curing the coating film for the protective layer. In addition, the coating liquid for the protective layer contains a solvent, a compound represented by the following general formula (1), a compound represented by the following general formula (2) and a compound represented by the following general formula (3). In addition, a content of the compound represented by the following general formula (2) is 0.001 mass % or more and 5.0 mass % or less with respect to the content of the compound represented by following general formula (1). In addition, a content of the compound represented by the following general formula (3) is 0.001 mass % or more and 5.0 mass % or less with respect to the content of the compound represented by following general formula (1).

(1)

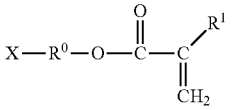

($R^0$ represents a single bond, a substituted or unsubstituted alkylene group, or a substituted or unsubstituted phenylene group, and $R^1$ each represents a hydrogen atom or a methyl group independently, and X represents a charge transport site.)

(2)

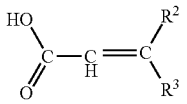

($R^2$ and $R^3$ each represent a hydrogen atom or a methyl group independently.)

(3)

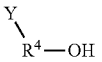

($R^4$ represents the single bond, the substituted or unsubstituted alkylene group, or the substituted or unsubstituted phenylene group, and Y represents the charge transport site.)

In addition, the electrophotographic photosensitive member according to an aspect of the present invention is an electrophotographic photosensitive member having a photosensitive layer and a protective layer above a support in this order, in which the protective layer is a film obtained by curing the coating liquid for the protective layer.

By forming the protective layer using the coating liquid for the protective layer, a mechanism of suppressing the occurrence of the image unevenness due to unevenness of the film thickness of the protective layer is not certain but is considered as follows.

The compound represented by the above general formula (1) has a carbonyl group having electrophilicity, and the compound represented by the above general formula (3) has a hydroxyl group having nucleophilicity, and the compound represented by the above general formula (2) has both the carbonyl group having electrophilicity and the hydroxyl group having nucleophilicity. Here, when the coating liquid for the protective layer contains only the compound represented by the above general formula (1) among the compounds represented by the above general formulas (1) to (3), the polymerizable functional groups contained in the compound represented by the above general formula (1) are aggregated by forming a hydrogen bond to each other. When the curing reaction proceeds while maintaining this aggregation state, the unevenness of the film thickness occurs.

On the other hand, when the coating liquid for the protective layer contains all of the respective compounds represented by the above general formulas (1) to (3), a special complex in which the hydrogen bond is dispersed is formed. That is, the hydrogen bond strength between the polymerizable functional groups contained in the compound represented by the above general formula (1) is weakened, and the aggregation of the compound represented by the above general formula (1) is suppressed. Therefore, it is considered that the unevenness of the film thickness is suppressed.

However, the content of the compound represented by the following general formula (2) is 0.001 mass % or more and 5.0 mass % or less with respect to the content of the compound represented by following general formula (1). In addition, the content of the compound represented by the following general formula (3) is 0.001 mass % or more and 5.0 mass % or less with respect to the content of the compound represented by following general formula (1). When the content of the compound represented by the above general formula (2) and the content of the compound represented by the above general formula (3) are each 0.001 mass % or more with respect to the content of the compound represented by the above general formula (1), the hydrogen bond strength between the compounds represented by the above general formula (1) can be weakened. In addition, when the content is 5.0 mass % or less, hardening inhibition which weakens the interaction between the compounds represented by the above general formula (1) is not caused.

It is preferable that the content of the compound represented by the above general formula (2) is 0.010 mass % or more and 2.0 mass % or less with respect to the content of the compound represented by the above formula (1), and the content of the compound represented by the above general formula (3) is 0.010 mass % or more and 2.0 mass % or less with respect to the content of the compound represented the general formula (1).

It is considered that the effects of the present invention can be achieved by the above mechanism.

Hereinafter, the electrophotographic photosensitive member according to an aspect of the present invention will be described in detail, including the method for producing the same.

First, a method for forming a protective layer will be described in detail.

The protective layer can be formed by coating the coating liquid for the protective layer on the photosensitive layer and curing the coating liquid for the coated protective layer. The coating liquid for the protective layer is cured by polymerizing (and crosslinking) the compound represented by the above general formula (1). The coating liquid for the protective layer contains a solvent, a compound represented by the above general formula (1), a compound represented by the above general formula (2) and the compound represented by the above general formula (3). In addition, electroconductive particles, a charge transporting substance, a binder resin, and an additive are further included, as necessary. In the curing of the coating liquid for the protective layer, the compound represented by the above general formula (1) contained in the coating liquid for the protective layer is polymerized (and crosslinked).

As described above, the content of the compound represented by the following general formula (2) in the coating liquid for the protective layer is 0.001 mass % or more and 5.0 mass % or less with respect to the content of the compound represented by following general formula (1). In addition, the content of the compound represented by the following general formula (3) is 0.001 mass % or more and 5.0 mass % or less with respect to the content of the compound represented by following general formula (1).

Examples of the solvent include an alcohol-based solvent, a ketone-based solvent, an ether-based solvent, a sulfoxide-based solvent, an ester-based solvent, an aromatic hydrocarbon-based solvent, an alicyclic alkyl-based solvent, and the like.

As a solvent, a solvent having an HSP value of 14.5 $MPa^{1/2}$ to 18.5 $MPa^{1/2}$ is preferable. In addition, it is preferable that the ratio of the compound represented by the above general formula (2) to the solvent having an HSP value of 14.5 $MPa^{1/2}$ or more and 18.5 $MPa^{1/2}$ or less is 0.01 mass % or more and 0.30 mass % or less.

In particular, it is more preferable that the solvent is a solvent having an HSP value of 14.5 $MPa^{1/2}$ or more and 18.5 $MPa^{1/2}$ or less, and the ratio of the compound represented by the above general formula (2) with respect to the solvent having an HSP value of 14.5 $MPa^{1/2}$ or more and 18.5 $MPa^{1/2}$ or less is 0.01 mass % or more and 0.30 mass % or less.

Since the solvent having an HSP value of 14.5 $MPa^{1/2}$ or more and 18.5 $MPa^{1/2}$ or less is a good solvent for the compound represented by the above general formula (1) and the compound represented by the above general formula (3), delocalization is promoted in the coating liquid.

In addition, since the solvent represented by the above general formula (2) is a slightly poor solvent, the compound represented by the above general formula (2) is charged between the compounds represented by the above general formula (1) for stabilization, the hydrogen bond between the compounds represented by the above general formula (1) is weakened. Therefore, the unevenness of the film thickness is suppressed.

More preferably, the solvent is an alicyclic alkyl.

Examples of the electro-conductive particles include particles of metal oxides such as titanium oxide, zinc oxide, tin oxide, and indium oxide.

Examples of the charge transporting substance include a polycyclic aromatic compound, a heterocyclic compound, a hydrazone compound, a styryl compound, an enamine compound, a benzidine compound, a triarylamine compound, and a resin having a group derived from the substances thereof. Among those, the triarylamine compound and the benzidine compound are preferable.

Examples of the binder resin include a polyester resin, an acrylic resin, a phenoxy resin, a polycarbonate resin, a polystyrene resin, a phenol resin, a melamine resin, an epoxy resin, and the like. Among those, the polycarbonate resin, the polyester resin, and the acrylic resin are preferable.

The protective layer may also contain additives such as an antioxidant, an ultraviolet light absorber, a plasticizer, a leveling agent, a slipperiness imparter, and an abrasion resistance improver. Examples of the additive include a hindered phenol compound, a hindered amine compound, a sulfur compound, a phosphorus compound, a benzophenone compound, a siloxane modified resin, silicone oil, fluorine resin particles, polystyrene resin particles, polyethylene resin particles, silica particles, alumina particles, boron nitride particles, and the like.

When coating the coating liquid for the protective layer, for example, a coating method such as a dip applying method (dip coating method), a spray coating method, a curtain coating method, and a spin coating method can be used. Among these coating methods, the dip coating method and the spray coating method are preferable from the viewpoint of efficiency and productivity.

From the viewpoint of suppressing the unevenness of the film thickness, it is preferable to have drying volatilizing the solvent between the forming of the coating film for the protective layer and the curing of the coating film for the protective layer. It is thought that this is because the solvent is rapidly volatilized by the drying, and the movement and aggregation of the compound represented by the above general formula (1) in the coating film are suppressed, and thus the unevenness of the film thickness is suppressed. The drying temperature is preferably 30° C. or higher and 70° C. or lower, and more preferably 40° C. or higher and 60° C. or lower. When the drying temperature is 30° C. or higher, the solvent volatilizes sufficiently, and when the drying temperature is 70° C. or lower, the protective layer and the photosensitive layer do not migrate and curing failure does not occur.

Examples of the method for polymerizing (and crosslinking) the compound represented by the above general formula (1) include a method for using heat, light such as visible light or ultraviolet ray, or radiation such as an electron beam or y ray. If necessary, the coating liquid for the protective layer may contain a polymerization initiator.

As the method for polymerizing (and crosslinking) the compound represented by the above general formula (1), since the polymerization initiator is not particularly required, a method for using radiation such as an electron beam or y ray, and in particular, a method for using an electron beam is preferable. By polymerizing (and crosslinking) the compound represented by the above general formula (1) without using the polymerization initiator, the protective layer of a very high purity three-dimensional matrix can be formed, and the electrophotographic photosensitive member indicating good electrophotographic characteristics can be obtained. In addition, among the radiations, the polymerization by the electron beam is particularly preferable because the damage to the electrophotographic photosensitive member due to the irradiation is very small and good electrophotographic characteristics can be obtained.

When the electron beam is irradiated, the electron beam can be irradiated using an accelerator such as a scanning type, an electro curtain type, a broad beam type, a pulse type, and a laminar type. The acceleration voltage is preferably 70 kV or less, and particularly preferably 50 kV or less. The irradiation dose is preferably 5 kGy or more and 45 kGy or less, and particularly preferably 10 kGy or more and 25 kGy or less. If the acceleration voltage is 70 kV or less or the irradiation dose is 45 kGy or less, the electrical characteristics of the electrophotographic photosensitive member do not deteriorate. In addition, when the irradiation dose is 5 kGy or more, the compound represented by the above general formula (1) is sufficiently polymerized (and crosslinked), and the coating liquid for the protective layer is sufficiently cured. The irradiation dose of the electron beam can be measured by a general-purpose film dosimeter, for example, RADIACHROMIC READER and Radiachromic dosimeter (10 μm) manufactured by Far West Technology.

In addition, in order to promote the curing of the coating liquid for the protective layer, when the compound represented by the above general formula (1) is polymerized (and crosslinked) by the electron beam, it is preferable to heat an irradiated body (one irradiated by the electron beam). The heating timing may be in any stage of before, during, or after the irradiation of the electron beam, but it is preferable that the temperature of the irradiated body becomes constant while the radical of the compound represented by the above general formula (1) is present. The heating is preferably performed so that the temperature of the irradiated body is 150° C. or lower, and more preferably performed so that the temperature of the irradiated body 130° C. or lower. When the temperature of the irradiated body is 150° C. or lower, the material of the electrophotographic photosensitive member does not deteriorate. On the other hand, the heating is preferably performed so that the temperature of the irradiated body is 100° C. or higher, and more preferably performed so that the temperature of the irradiated body is 110° C. or higher. When the temperature of the irradiated body is 100° C. or higher, the effect obtained by heating can be sufficiently obtained. The heating time is preferably 5 seconds or more and 60 seconds or less, and more preferably 10 seconds or more and 30 seconds or less. When the heating time is 5 seconds or more, the effect obtained by heating is sufficiently obtained, and when it is 60 seconds or less, the material does not deteriorate.

The atmosphere at the time of irradiating the electron beam and heating the irradiated body may be in an atmospheric air, in an inert gas such as nitrogen or helium, or in vacuum, but a deactivation of radical by oxygen can be suppressed, and therefore, the atmosphere is preferably in the inert gas or the vacuum. An oxygen concentration is preferably 100 ppm or less, and more preferably 50 ppm or less.

In addition, from the viewpoint of the electrophotographic characteristics, the film thickness of the protective layer of the electrophotographic photosensitive member is preferably 10 μm or less, and more preferably 5 μm or less. On the other hand, from the viewpoint of the durability of the electrophotographic photosensitive member, the film thickness of the protective layer is preferably 0.5 μm or more, and more preferably 1 μm or more.

The suitable example (compound example) of the compound represented by the above general formula (1) is mentioned below.

| Formula | Example of compound |
|---|---|
| 1-1 | 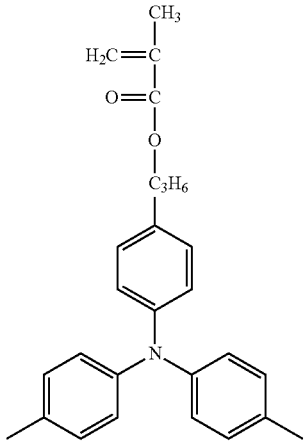 |

-continued
| Formula | Example of compound |
|---|---|
| 1-2 | 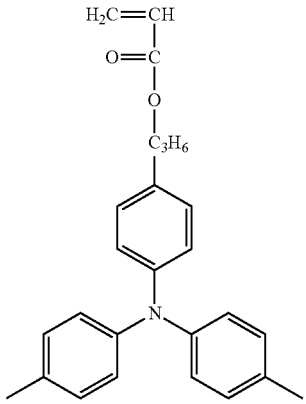 |
| 1-3 | 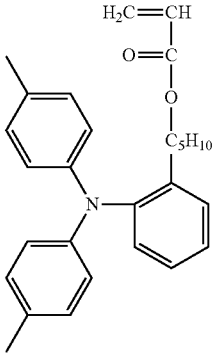 |
| 1-4 | 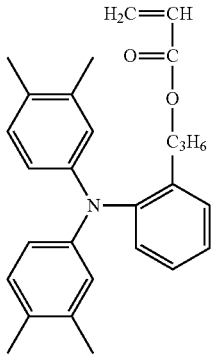 |
| 1-5 | 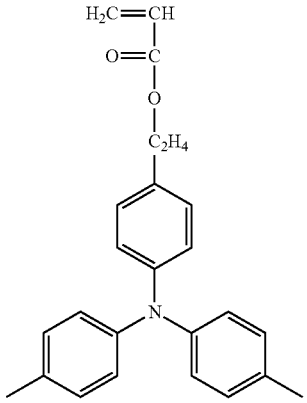 |
-continued
| Formula | Example of compound |
|---|---|
| 1-6 | 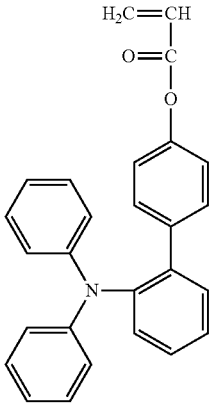 |
| 1-7 | 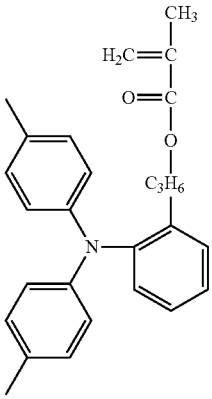 |
| 1-8 | 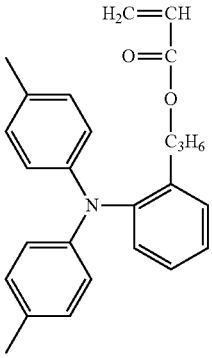 |
| 1-9 | 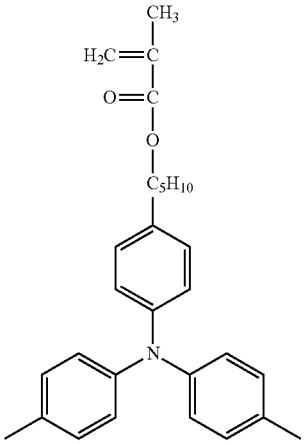 |

-continued
| Formula | Example of compound |
|---|---|
| 1-10 | 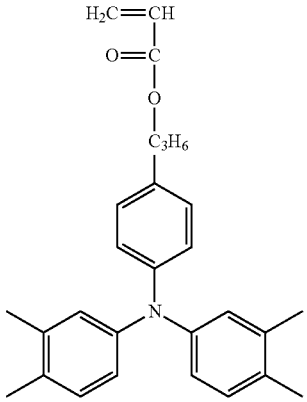 |
| 1-11 | 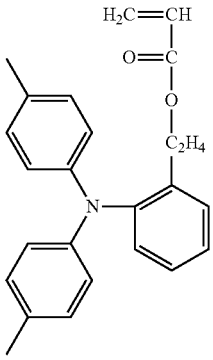 |
| 1-12 | 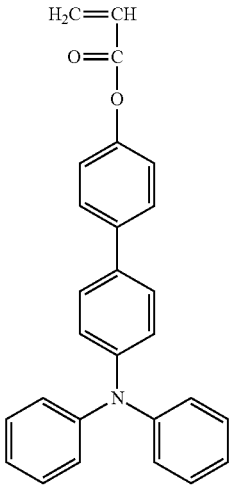 |
-continued
| Formula | Example of compound |
|---|---|
| 1-13 | 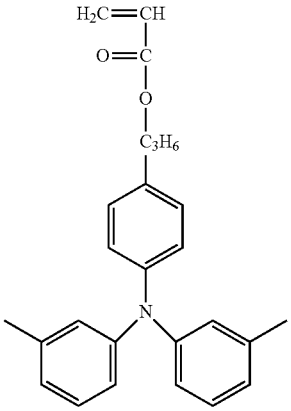 |
| 1-14 | 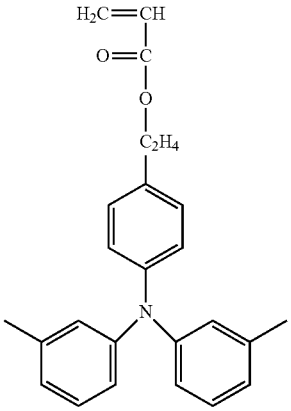 |
| 1-15 | 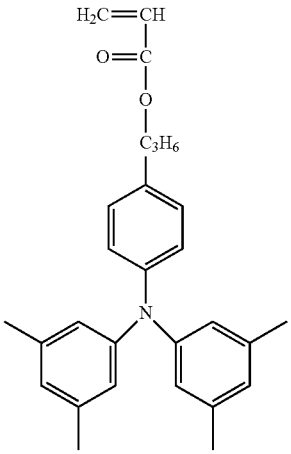 |

-continued
| Formula | Example of compound |
|---|---|
| 1-16 | 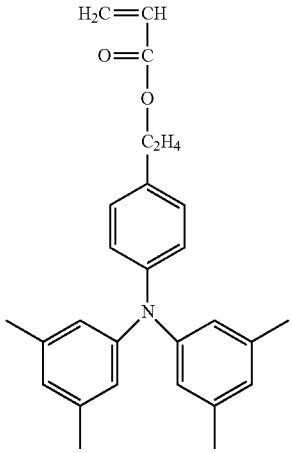 |
| 1-17 | 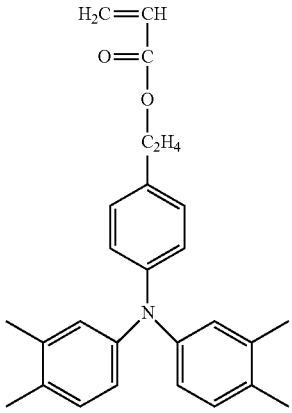 |
| 1-18 | 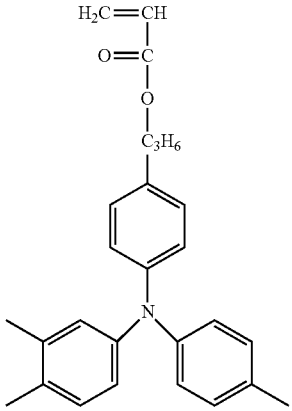 |
-continued
| Formula | Example of compound |
|---|---|
| 1-19 | 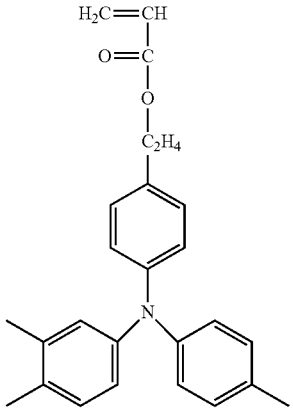 |
| 1-20 | 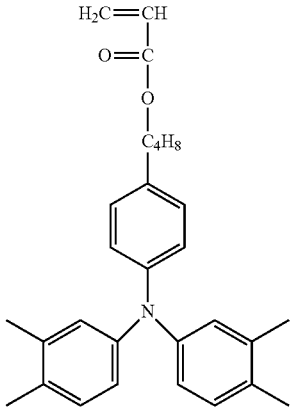 |
| 1-21 | 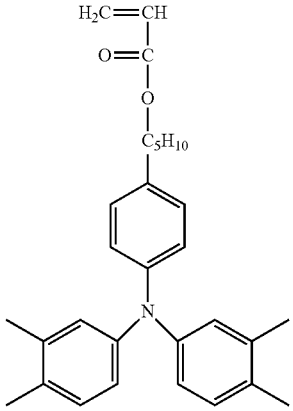 |
The suitable example (compound example) of the compound represented by the above general formula (2) is mentioned below.
(2-1)
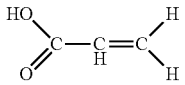

-continued
(2-2)
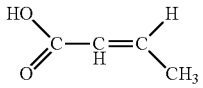
The suitable example (compound example) of the compound represented by the above general formula (3) is mentioned below.
| Formula | Example of compound |
|---|---|
| 3-1 | 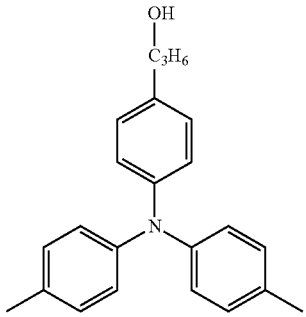 |
| 3-2 | 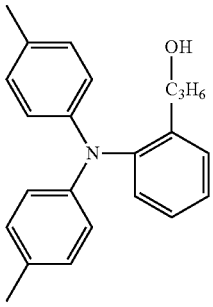 |
| 3-3 | 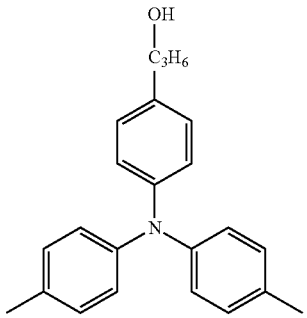 |
| 3-4 | 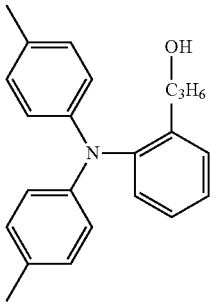 |
-continued
| Formula | Example of compound |
|---|---|
| 3-5 | 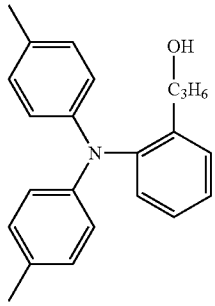 |
| 3-6 | 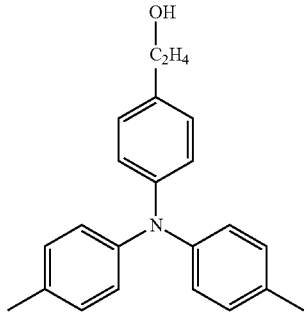 |
| 3-7 | 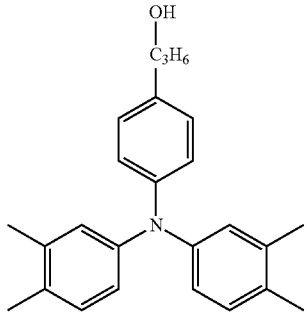 |
| 3-8 | 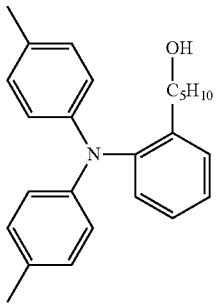 |
| 3-9 | 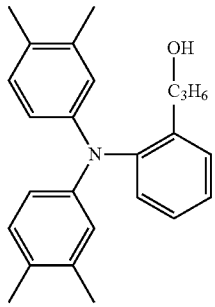 |

-continued

| Formula | Example of compound |
|---|---|
| 3-10 | 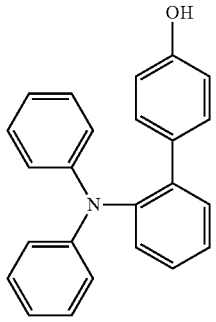 |
| 3-11 | 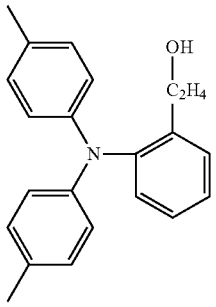 |
| 3-12 | 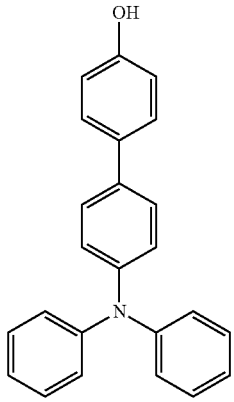 |

Preferred examples of the solvent include cyclohexane, cyclopentane, ethyl acetate, trans-2-butene, and the like.

Next, the electrophotographic photosensitive member according to an aspect of the present invention will be described in detail, including a layer other than the protective layer.

As a method of producing an electrophotographic photosensitive member according to the present invention, there may be mentioned a method for preparing a coating liquid for each layer to be described later, applying the coating liquid in the order of desired layers, and drying the layers. At this time, examples of a method of coating a coating liquid include dip coating, spray coating, inkjet coating, roll coating, die coating, blade coating, curtain coating, wire bar coating, ring coating, and the like. Among those, the dip coating is preferable from the viewpoint of efficiency and productivity.

Hereinafter, each layer will be described.

<Support>

In the present invention, the electrophotographic photosensitive member has the support. In the present invention, the support is preferably an electro-conductive support having electrical conductivity. In addition, examples of a shape of the support include a cylindrical shape, a belt shape, a sheet shape and the like. Among those, the cylindrical support is preferable. In addition, the surface of the support may be subjected to electrochemical treatment such as anodization, plasma treatment, cutting treatment, and the like.

Examples of a material of the support body preferably include metal, resin, glass, and the like.

Examples of the metal include aluminum, iron, nickel, copper, gold, stainless steel, or alloys thereof, and the like. Among those, an aluminum support is preferable. In addition, a resin or glass may have electrical conductivity by processing such as mixing or coating of an electro-conductive material.

<Electro-Conductive Layer>

In the present invention, an electro-conductive layer may be provided above a support. By providing the electro-conductive layer, it is possible to conceal scratches or irregularities on a surface of the support or to control light reflection on the surface of the support.

The electro-conductive layer preferably contains an electro-conductive particle and a resin.

Examples of the material of the electro-conductive particle include metal oxide, metal, carbon black and the like.

Examples of the metal oxide include zinc oxide, aluminum oxide, indium oxide, silicon oxide, zirconium oxide, tin oxide, titanium oxide, magnesium oxide, antimony oxide, bismuth oxide, and the like. Examples of the metal include aluminum, nickel, iron, nichrome, copper, zinc, silver, and the like.

Among those, it is preferable to use the metal oxide as the electro-conductive particles, and in particular, it is more preferable to use titanium oxide, tin oxide, or zinc oxide as the electro-conductive particles.

When the metal oxide is used as the electro-conductive particle, the surface of the metal oxide may be treated with a silane coupling agent and the like, or the metal oxide may be doped with an element such as phosphorus or aluminum or an oxide thereof.

In addition, the electro-conductive particle may have a laminated structure having core particles and a coating layer covering the particles. Examples of the core particles include titanium oxide, barium sulfate, zinc oxide, and the like. The covering layer may, for example, be a metal oxide such as tin oxide.

In addition, when the metal oxide is used as the electro-conductive particles, a volume average particle diameter is preferably 1 nm or more and 500 nm or less, and more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, an alkyd resin, and the like.

In addition, the electro-conductive layer may further contain a masking agent and the like such as silicone oil, resin particles, and titanium oxide.

An average film thickness of the electro-conductive layer is preferably 1 μm or more and 50 μm or less, and particularly preferably 3 μm or more and 40 μm or less.

The electro-conductive layer can be formed by preparing a coating liquid for an electro-conductive layer containing the above-described respective materials and a solvent, forming a coating film thereof, and drying the coating film. Examples of the solvent used for the coating liquid include an alcohol-based solvent, a sulfoxide-based solvent, a ketone-based solvent, an ether-based solvent, an ester-based solvent, an aromatic hydrocarbon-based solvent, and the like. Examples of a dispersion method for dispersing electro-conductive particles in a coating liquid for electro-conductive layer include a method using a paint shaker, a sand mill, a ball mill, or a liquid collision type high speed disperser.

<Undercoat Layer>

In the present invention, an undercoat layer may be provided above a support or an electro-conductive layer. By providing the undercoat layer, an adhesion function between the layers can be increased and a charge injection blocking function can be provided.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, a cellulose resin, and the like.

Examples of the composition containing a monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic anhydride group, a carbon-carbon double bond group, and the like.

In addition, the undercoat layer may further contain an electron transporting substance, metal oxide, metal, an electro-conductive polymer, and the like for the purpose of enhancing electrical properties. Among those, the electron transporting substance and the metal oxide are preferably used.

Example of the electron transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, a boron-containing compound, and the like. The undercoat layer may be formed as a cured film by using the electron transporting substance having the polymerizable functional group as the electron transporting substance and copolymerizing with the monomer having the above-described polymerizable functional group.

Examples of the metal oxide include indium tin oxide, tin oxide, indium oxide, titanium oxide, zinc oxide, aluminum oxide, silicon dioxide, and the like. Examples of the metal include gold, silver, aluminum, and the like.

In addition, the undercoat layer may further contain an additive.

An average film thickness of the undercoat layer is preferably 0.1 μm or more and to 50 μm or less, more preferably 0.2 μm or more and 40 μm or less, and particularly preferably 0.3 μm or more to 30 μm or less.

The undercoat layer can be formed by preparing the coating liquid for the undercoat layer containing the above-described respective materials and solvents, forming a coating film thereof, and drying and/or curing the coating film. Examples of the solvent used for the coating liquid include an alcohol-based solvent, a ketone-based solvent, an ether-based solvent, an ester-based solvent, an aromatic hydrocarbon solvent, and the like.

<Photosensitive Layer>

A photosensitive layer of an electrophotographic photosensitive member is mainly classified into (1) a laminated type photosensitive layer and (2) a single layer type photosensitive layer. (1) The laminated photosensitive layer has a charge generating layer containing a charge generating substance, and a charge transporting layer containing the charge transporting substance. (2) The single layer type photosensitive layer has a photosensitive layer containing both the charge generating substance and the charge transporting substance.

In the present invention, the photosensitive layer preferably has a charge transporting substance represented by the following general formula (C1) or a charge transporting substance represented by the following general formula (C2).

The mechanism is not certain, but is considered as follows. That is, since a skeleton around an aromatic ring is flexible, the charge transporting substance tends to cause hydrophobic interaction with the charge transport site of the compound which is contained in the protective layer and represented by the above general formula (1). As a result, in the compound represented by the above general formula (1) contained in the protective layer, the interaction between the polymerizable functional groups at the relative position to the charge transport site is weakened. As a result, it is considered that the aggregation due to hydrogen bonding is weakened and the unevenness of the film thickness is suppressed.

(C1)

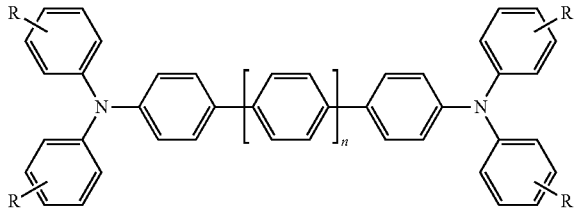

(In the general formula (C1), n is 0, 1, or 2 and R represents a hydrogen atom or a methyl group.)

(C2)

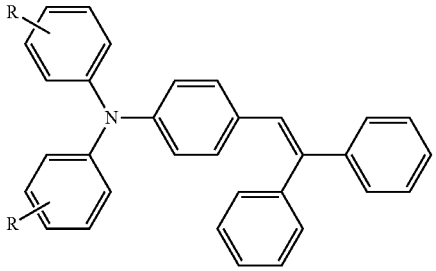

(In the general formula (C2), R represents a hydrogen atom or a methyl group.)

(1) Laminated Photosensitive Layer

The laminated photosensitive layer has the charge generating layer and the charge transporting layer.

(1-1) Charge Generating Layer

The charge generating layer preferably contains the charge generating substance and the resin.

Examples of the charge generating substance include an azo pigment, a perylene pigment, a polycyclic quinone pigment, an indigo pigment, a phthalocyanine pigment, and the like. Among those, the azo pigment and the phthalocyanine pigment are preferable. Among the phthalocyanine pigments, an oxytitanium phthalocyanine pigment, a chlorogallium phthalocyanine pigment, and a hydroxygallium phthalocyanine pigment are preferable.

The content of the charge generation material in the charge generating layer is preferably 40 mass % or more to 85 mass % or less, and more preferably 60 mass % or more to 80 mass % or less with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among those, the polyvinyl butyral resin is more preferable.

In addition, the charge generating layer may further contain additives such as an antioxidant and a UV absorber. Specifically, a hindered phenol compound, a hindered amine compound, a sulfur compound, a phosphorus compound, a benzophenone compound, and the like can be mentioned.

An average film thickness of the charge generating layer is preferably 0.1 or more and 1 μm or less, and particularly preferably 0.15 μm or more and 0.4 or less.

The charge generating layer can be formed by preparing a coating liquid for the charge generating layer containing the above-described respective materials and solvents, forming a coating film thereof, and drying the coating film. Examples of the solvent used for the coating liquid include an alcohol-based solvent, a sulfoxide-based solvent, a ketone-based solvent, an ether-based solvent, an ester-based solvent, an aromatic hydrocarbon-based solvent, and the like.

(1-2) Charge Transporting Layer

The charge transporting layer preferably contains the charge transporting substance and the resin.

In the present invention, as described above, the charge transporting substance represented by the above general formula (C1) or the charge transporting substance represented by the above general formula (C2) is a preferred charge transporting substance. Examples of other charge transporting substances include a polycyclic aromatic compound, a heterocyclic compound, a hydrazone compound, a styryl compound, an enamine compound, a benzidine compound, a triarylamine compound, and a resin having a group derived from the materials thereof. Among those, the triarylamine compound and the benzidine compound are preferable.

The content of the charge transporting substance in the charge transporting layer is preferably 25 mass % or more to 70 mass % or less, and more preferably 30 mass % or more and 55 mass % or less with respect to the total mass of the charge transporting layer.

Examples of the resin include a polyester resin, a polycarbonate resin, an acrylic resin, and a polystyrene resin and the like. Among those, a polycarbonate resin and a polyester resin are preferable. As the polyester resin, a polyarylate resin is particularly preferable.

A content ratio (mass ratio) of the charge transporting substance and the resin is preferably 4:10 to 20:10, and more preferably 5:10 to 12:10.

In addition, the charge transporting layer may also contain additives such as an antioxidant, an ultraviolet light absorber, a plasticizer, a leveling agent, a slipperiness imparter, and an abrasion resistance improver. Specifically, there may be a hindered phenol compound, a hindered amine compound, a sulfur compound, a phosphorus compound, a benzophenone compound, a siloxane modified resin, silicone oil, fluorine resin particles, polystyrene resin particles, polyethylene resin particles, silica particles, alumina particles, boron nitride particles, and the like.

An average film thickness of the charge transporting layer is preferably 5 μm or more and 50 μm or less, more preferably 8 μm or more and 40 μm or less, and particularly preferably 10 μm or more and 30 μm or less.

The charge transporting layer can be formed by preparing a coating liquid for the charge transporting layer containing the above-described respective materials and solvents, forming a coating film thereof, and drying the coating film. Examples of the solvent used for the coating liquid include an alcohol-based solvent, a ketone-based solvent, an ether-based solvent, an ester-based solvent, an aromatic hydrocarbon solvent, and the like. Among these solvents, the ether-based solvent or the aromatic hydrocarbon solvent are preferable.

Preferred examples (example of compounds) of the charge transporting substance other than the compound represented by the above general formula (C1) and the compound represented by the above general formula (C2) are mentioned below.

(CTM-1)

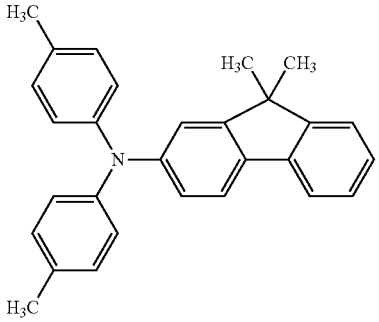

(CTM-2)

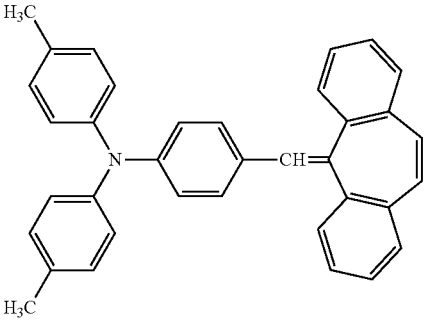

-continued
(CTM-3)
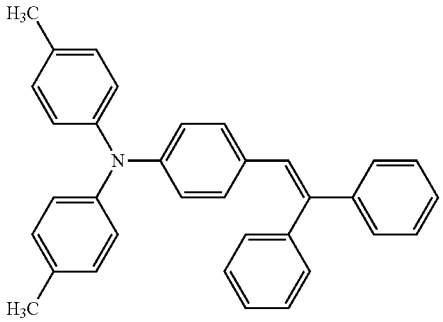
(CTM-4)
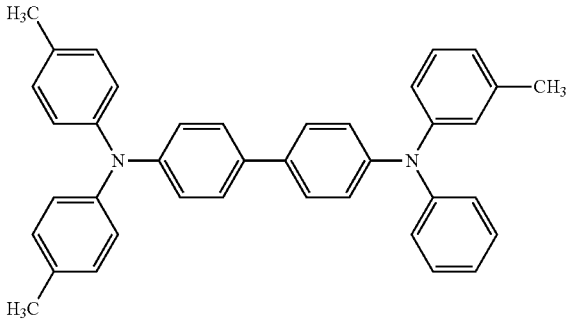
(CTM-5)
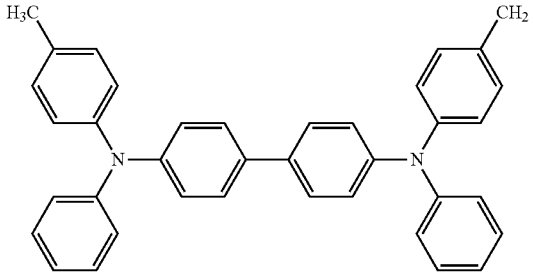
(CTM-6)
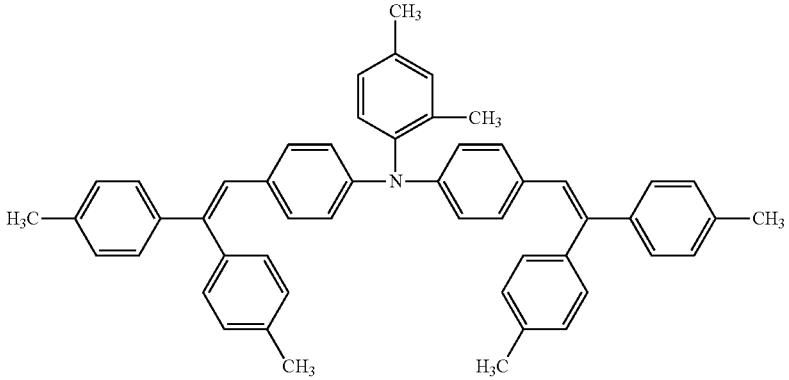
(CTM-7)
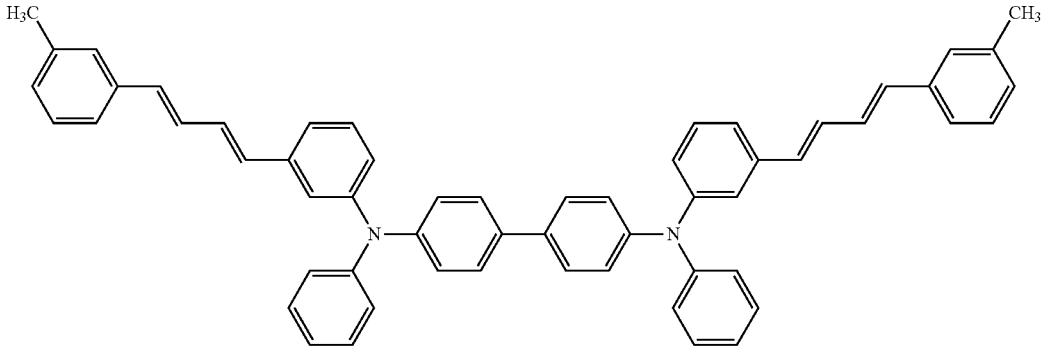

-continued (CTM-8)

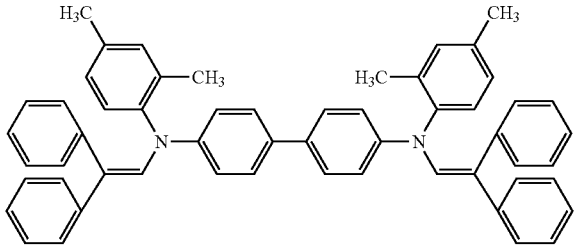

(CTM-9)

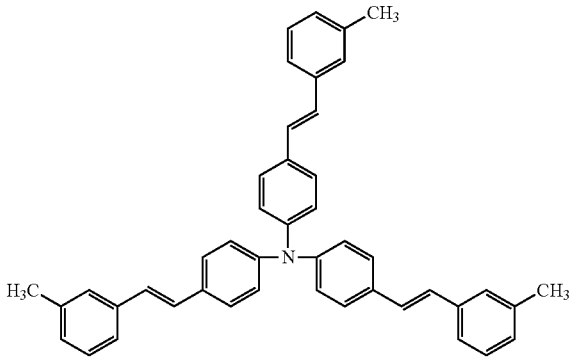

(CTM-10)

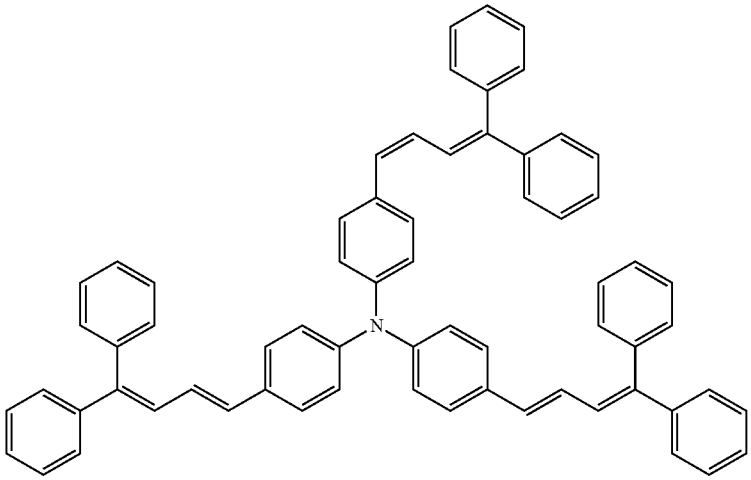

(2) Single Layer Type Photosensitive Layer

A single layer type photosensitive layer can be formed by preparing a coating liquid for a photosensitive layer containing a charge generating substance, a charge transporting substance, a resin, and a solvent, forming a coating film thereof, and drying the coating film. The charge generating substance, the charge transporting substance, and the resin are the same as the examples of the material in the above-mentioned "(1) laminated type photosensitive layer".

[Process Cartridge, Electrophotographic Apparatus]

A process cartridge according to the present invention integrally supports the electrophotographic photosensitive member described so far and at least one unit selected from the group consisting of a charging unit, a developing unit, a transfer unit, and a cleaning unit, and is detachably attachable to a main body of an electrophotographic apparatus.

In addition, an electrophotographic apparatus according to the present invention includes the electrophotographic photosensitive member described so far, a charging unit, an exposure unit, a developing unit, and a transfer unit.

FIG. 1*s* a diagram showing an example of a schematic configuration of an electrophotographic apparatus having a process cartridge provided with an electrophotographic photosensitive member.

Reference numeral 1 is a cylindrical electrophotographic photosensitive member and is rotationally driven around the axis 2 in an arrow direction at a predetermined circumferential speed. A surface of the electrophotographic photosensitive member 1 is charged to a predetermined positive or negative potential by the charging unit 3. In addition, although a roller charging system using a roller type charging member is shown in the drawing, a charging system such as a corona charging system, a proximity charging system, and an injection charging system may be employed. The exposure light 4 is irradiated from the exposure unit (not shown) on the charged surface of the electrophotographic photosensitive member 1, and an electrostatic latent image corresponding to targeted image information is formed on the charged surface of the electrophotographic photosensitive member 1. The electrostatic latent image formed on the surface of the electrophotographic photosensitive member 1 is developed by a toner accommodated in the developing unit 5, and a toner image is formed on the surface of the electrophotographic photosensitive member 1. The toner image formed on the surface of the electrophotographic photosensitive member 1 is transferred to the transfer material 7 by the transfer unit 6. The transfer material 7 to which the toner image is transferred is conveyed to the fixing unit 8, subjected to fixing processing of the toner image, and printed out to an outside of the electrophotographic apparatus. The electrophotographic apparatus may have a cleaning unit 9 for removing deposits such as a toner remaining on the surface of the electrophotographic photosensitive member 1 after the transfer. In addition, a so-called cleanerless system may be used in which the attached matter is removed using the developing unit 5 or the like without separately providing a cleaning unit 9. The electrophotographic apparatus may have an antistatic mechanism for removing electricity the surface of the electrophotographic photosensitive member 1 with the pre-exposure light 10 from the pre-exposure unit (not shown). Further, in order to detach the process cartridge 11 according to an aspect of the present invention to the electrophotographic apparatus main body, the guide unit 12 such as a rail may be provided.

The electrophotographic photosensitive member according to the present invention can be used for a laser beam printer, an LED printer, a copying machine, a facsimile, a composite machine thereof, and the like.

According to the present invention, the electrophotographic photosensitive member capable of suppressing the occurrence of the image unevenness due to the unevenness of the film thickness of the protective layer and having the excellent abrasion resistance and the method for producing the same are provided.

EXAMPLE

Hereinafter, the present invention will be described in more detail with reference to Examples and Comparative Examples. The present invention is not limited to the following examples as long as the present invention does not depart from the gist. In the following description of the examples, "part" is on a mass basis unless otherwise noted.

Example 1

An aluminum cylinder (JIS-A3003, aluminum alloy) having a diameter of 24 mm and a length of 257.5 mm was used as a support (electro-conductive support).

Next, the following materials were prepared.

- 214 parts of titanium oxide ($TiO_2$) particles (average primary particle diameter 230 nm) coated with oxygen deficient tin oxide ($SnO_2$) as metal oxide particles
- 132 parts of phenol resin (monomer/oligomer of phenol resin) as a binding material (trade name: Plyofen J-325, Dainippon Ink and Chemicals, Inc., resin solid content: 60 mass %) as a binding material
- 98 parts of 1-methoxy-2-propanol as a solvent These materials are placed into a sand mill using 450 parts of glass beads having a diameter of 0.8 mm, and are subjected to dispersion treatment in the conditions that a rotation speed is 2000 rpm, a dispersion treatment time is 4.5 hours, and a preset temperature of cooling water: 18° C., thereby obtaining a dispersion. Glass beads were removed from the dispersion by a mesh (mesh opening: 150 μm). In addition, silicone resin particles (trade name: Tospearl 120, manufactured by Momentive Performance Materials Co., Ltd., average particle diameter 2 μm) as a surface roughening imparter were added to the dispersion. The addition amount was set to be 10 mass % with respect to the total mass of the metal oxide particles and the binding material in the dispersion after removing the glass beads. In addition, silicone oil (trade name: SH28PA, manufactured by Toray Dow Corning Co., Ltd.) as a leveling agent was added to the dispersion so as to be 0.01 mass % with respect to the total mass of the metal oxide particles in the dispersion and the binding material. Next, a mixed solvent of methanol and 1-methoxy-2-propanol (1:1 mass ratio) was added to the dispersion so that a total mass (that is, a mass of a solid content) of the metal oxide particles in the dispersion, the binding material, and the surface roughening imparter is 67 mass % with respect to the mass of the dispersion. Thereafter, the coating liquid for the electro-conductive layer was prepared by stirring. The coating liquid for the electro-conductive layer was dip-coated on the support, and was heated at 140° C. for 1 hour to form an electro-conductive layer having a film thickness of 30 μm.

Next, the following materials were prepared.

- 4 parts of electron transporting substance represented by the following formula E-1
- 5.5 parts of blocked isocyanate (trade name: Duranate SBN-70D, manufactured by Asahi Kasei Chemicals Corporation)
- 0.3 parts of polyvinyl butyral resin (S-LEC KS-5Z, manufactured by Sekisui Chemical Co., Ltd.)
- 0.05 parts of zinc (II) hexanoate (Mitsuwa Chemical Co., Ltd.) as a catalyst These were dissolved in a mixed solvent of 50 parts of tetrahydrofuran and 50 parts of 1-methoxy-2-propanol to prepare a coating liquid for an undercoat layer. The coating liquid for the undercoat layer was dip-coated on the electro-conductive layer, and heated at 170° C. for 30 minutes to form an undercoat layer having a film thickness of 0.7 μm.

(E-1)

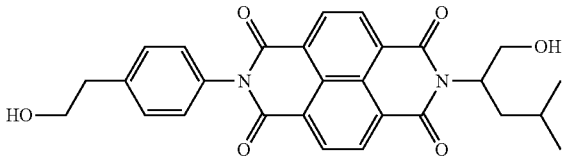

Next, the following materials were prepared.

- 10 parts of hydroxygallium phthalocyanine in a crystalline form having a peak at a position of 7.5° and 28.4° in a chart obtained from CuKα characteristic X-ray diffraction
- 5 parts of polyvinyl butyral resin (trade name: S-LEC BX-1, manufactured by Sekisui Chemical Co., Ltd.)

These materials are added to 200 parts of cyclohexanone, dispersed for 6 hours with a sand mill apparatus using glass beads having a diameter of 0.9 mm, and further added with 150 parts of cyclohexanone and 350 parts of ethyl acetate and diluted to obtain a coating liquid for a charge generating layer. The obtained coating liquid was dip-coated on the undercoat layer and dried at 95° C. for 10 minutes to form a charge generating layer having a thickness of 0.20 μm. In addition, the measurement of the X-ray diffraction was performed under the following conditions.

[Powder X-ray Diffraction Measurement]

Measuring instrument used: X-ray diffractometer RINT-TTRII manufactured by Rigaku Denki Co., Ltd.
X-ray tube: Cu
Tube voltage: 50 KV
Tube current: 300 mA
Scan method: 2θ/θ scan
Scan speed: 4.0°/min
Sampling interval: 0.02°
Start angle (2θ): 5.0°
Start angle (2θ): 40.0°
Attachment: Standard sample holder
Filter: Not used
Incident monochrome: Used
Counter monochrome meter: Not used
Divergent slit: Open
Divergence vertical restriction slit: 10.00 mm
Scattering slit: Open
Light receiving slit: Open Flat panel monochromator: Used
Counter: Scintillation counter Next, the following materials were prepared.

6 parts of compound (charge transporting substance (hole transporting compound)) represented by the following formula C1-1

4 parts of compound (charge transporting substance (hole transporting compound)) represented by the following formula C2-1

10 parts of polycarbonate (trade name: Iupilon Z400, manufactured by Mitsubishi Engineering Plastics Co., Ltd.)

0.02 parts of polycarbonate resin having a structure represented by the following formula (P1) and a structure represented by the following formula (P2) (x/y=0.95/0.05:viscosity average molecular weight=20000)

These were dissolved in a mixed solvent of 25 parts of ortho-xylene/25 parts of methyl benzoate/25 parts of dimethoxymethane to prepare a coating liquid for charge transporting layer. The coating liquid for the charge transporting layer was dip-coated on the charge generating layer to form a coating film, and the coating film was dried at 120° C. for 30 minutes to form a charge transporting layer having a thickness of 12

(C1-1)

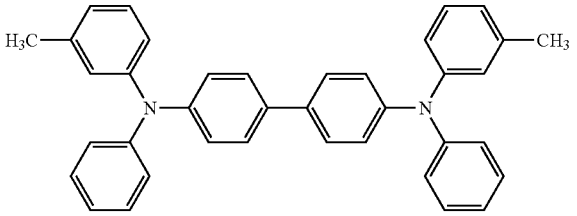

(C2-1)

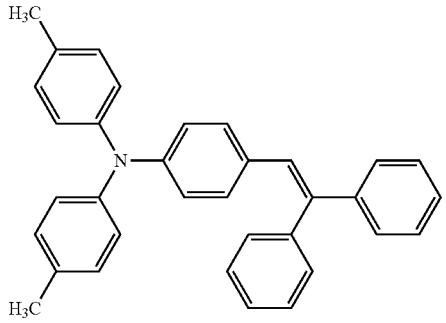

(P1)

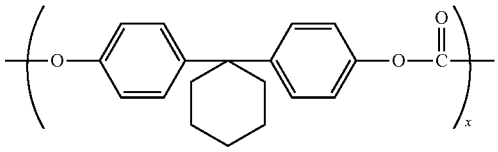

(P2)

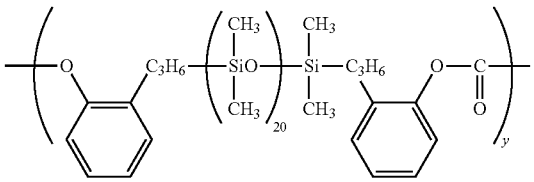

Next, the following materials were prepared.

31.5 parts of compound represented by the above formula 1-10

3.5 parts of compound represented by the following formula 01

0.076 parts of compound represented by the above formula 2-1 (that is, 0.242 mass % with respect to the compound represented by the above formula 1-10)

0.076 parts of compound represented by the above formula 3-1 (that is, 0.242 mass % with respect to the compound represented by the above formula 1-10)

These materials were mixed with 46 parts of cyclohexane (that is, 0.17 mass % with respect to the compound represented by the above formula 2-1) and 20 parts of n-propanol and stirred. Thereafter, this solution was filtered with a polyfluorocarbon filter (trade name: PF-020, manufactured by Advantec Toyo Kaisha, Ltd.) to prepare the coating liquid for the protective layer.

(O1)

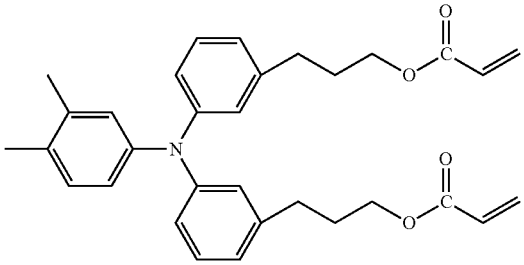

The coating liquid for the surface layer was dip-coated on the charge transporting layer to form the coating film, and the obtained coating film was dried at 50° C. for 6 minutes. Thereafter, in the conditions of an acceleration voltage of 50 kV and a beam current of 5.0 mA under a nitrogen atmosphere, a distance between the support (irradiated body) and the electron beam irradiation window was set to be 20 mm, and the coating film was irradiated with an electron beam for 2.8 seconds while the support (irradiated body) is rotated at a speed of 200 rpm. In addition, when the absorbed dose of the electron beam at this time was measured, it was 15 kGy. Here, the absorbed dose of the electron beam is measured when the film of the Radiachromic dosimeter (10 μm) is attached to the surface of the electrophotographic photosensitive member before the coating liquid for the protective layer is coated and the electron beam is irradiated in that state.

Thereafter, the coating film was heated by raising the temperature from 25° C. to 117° C. over 20 seconds under the nitrogen atmosphere. The oxygen concentration from electron beam irradiation to the subsequent heat treatment was 10 ppm or less. Next, after the coating film is naturally cooled until the temperature of the coating film is 25° C. in the atmospheric air, the coating film was subjected to heating treatment for 30 minutes in the condition that the temperature of the coating film is 105° C. to form the protective layer having a film thickness of 3 μm. By doing so, a cylindrical (drum-like) electrophotographic photosensitive member according to Example 1 having a support, an electro-conductive layer, an undercoat layer, a charge generating layer, a charge transporting layer, and a protective layer in this order was produced.

Examples 2 to 43, Comparative Examples 1 to 8

Electrophotographic photosensitive members according to each Examples and Comparative Examples were produced in the same manner as in Example 1 except that each condition shown below were as shown in Tables 1 and 2.

- Type of compound used for a coating liquid for a protective layer
- A ratio of the compound represented by the above general formula (2) to the compound represented by the above general formula (1)
- A ratio of the compound represented by the above general formula (3) to the compound represented by the above general formula (1)
- Type of solvent
- A ratio of the compound represented by the general formula (2) with respect to the solvent
- Type of compounds represented by charge transporting substances used in a coating liquid for a charge transporting layer In addition, the compound used in place of the compound represented by the general formula (1) in Comparative Example 1 is a compound represented by the following formula (A).

(A)

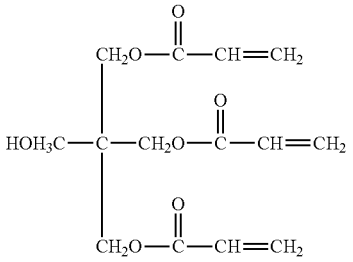

In addition, the compound used in place of the compound represented by the general formula (2) in Comparative Example 2 is a compound represented by the following formula (B).

(B)

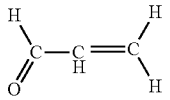

In addition, the compound used in place of the compound represented by the general formula (3) in Comparative Example 3 is a compound represented by the following formula (C).

(C)

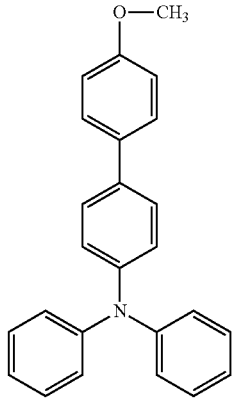

Example 44

An electrophotographic photosensitive member was produced in the same manner as in Example 1 except that the coating liquid for the protective layer was coated and then cured without being dried

TABLE 1

| | Formula (1) | Formula (2) | Formula (3) | Formula (2)/ formula (1) (%) | Formula (3)/ formula (1) (%) | HSP value of solvent ($MPa^{1/2}$) | Formula (2)/solvent (%) | Solvent | Charge transport Substance 1 | Charge transport Substance 2 | Before curing Drying |
|---|---|---|---|---|---|---|---|---|---|---|---|
| Example 1 | 1-10 | 2-1 | 3-1 | 0.175 | 0.175 | 16.8 | 0.170 | Cyclohexane | C1-1 | C2-1 | Presence |
| Example 2 | 1-10 | 2-1 | 3-1 | 4.800 | 0.175 | 16.8 | 0.170 | Cyclohexane | C1-1 | C2-1 | Presence |
| Example 3 | 1-10 | 2-1 | 3-1 | 0.175 | 4.800 | 16.8 | 0.170 | Cyclohexane | C1-1 | C2-1 | Presence |
| Example 4 | 1-10 | 2-1 | 3-1 | 0.003 | 0.175 | 16.8 | 0.170 | Cyclohexane | C1-1 | C2-1 | Presence |
| Example 5 | 1-10 | 2-1 | 3-1 | 0.175 | 0.003 | 16.8 | 0.170 | Cyclohexane | C1-1 | C2-1 | Presence |
| Example 6 | 1-12 | 2-1 | 3-1 | 0.175 | 0.175 | 16.8 | 0.170 | Cyclohexane | C1-1 | C2-1 | Presence |
| Example 7 | 1-10 | 2-2 | 3-1 | 0.175 | 0.175 | 16.8 | 0.170 | Cyclohexane | C1-1 | C2-1 | Presence |
| Example 8 | 1-10 | 2-1 | 3-12 | 0.175 | 0.175 | 16.8 | 0.170 | Cyclohexane | C1-1 | C2-1 | Presence |
| Example 9 | 1-10 | 2-1 | 3-1 | 0.175 | 0.175 | 18.2 | 0.270 | Ethyl acetate | C1-1 | C2-1 | Presence |
| Example 10 | 1-10 | 2-1 | 3-1 | 0.175 | 0.175 | 18.2 | 0.030 | Ethyl acetate | C1-1 | C2-1 | Presence |
| Example 11 | 1-10 | 2-1 | 3-1 | 0.175 | 0.175 | 14.9 | 0.270 | Trans-2-butene | C1-1 | C2-1 | Presence |
| Example 12 | 1-10 | 2-1 | 3-1 | 0.175 | 0.175 | 14.9 | 0.030 | Trans-2-butene | C1-1 | C2-1 | Presence |
| Example 13 | 1-10 | 2-1 | 3-1 | 0.175 | 0.175 | 18.2 | 0.500 | Ethyl acetate | C1-1 | C2-1 | Presence |
| Example 14 | 1-10 | 2-1 | 3-1 | 0.175 | 0.175 | 18.2 | 0.005 | Ethyl acetate | C1-1 | C2-1 | Presence |
| Example 15 | 1-10 | 2-1 | 3-1 | 0.175 | 0.175 | 14.9 | 0.500 | Trans-2-butene | C1-1 | C2-1 | Presence |
| Example 16 | 1-10 | 2-1 | 3-1 | 0.175 | 0.175 | 14.9 | 0.005 | Trans-2-butene | C1-1 | C2-1 | Presence |
| Example 17 | 1-10 | 2-1 | 3-1 | 0.175 | 0.175 | 19.8 | 0.270 | 2-methyl Cyclohexanone | C1-1 | C2-1 | Presence |
| Example 18 | 1-10 | 2-1 | 3-1 | 0.175 | 0.175 | 19.8 | 0.030 | 2-methyl Cyclohexanone | C1-1 | C2-1 | Presence |
| Example 19 | 1-10 | 2-1 | 3-1 | 0.175 | 0.175 | 13.8 | 0.270 | Hexafluoro-1,3-butadiene | C1-1 | C2-1 | Presence |
| Example 20 | 1-10 | 2-1 | 3-1 | 0.175 | 0.175 | 13.8 | 0.030 | Hexafluoro-1,3-butadiene | C1-1 | C2-1 | Presence |
| Example 21 | 1-10 | 2-1 | 3-1 | 0.175 | 0.175 | 17.3 | 0.270 | Cycloheptane | C1-1 | C2-1 | Presence |
| Example 22 | 1-10 | 2-1 | 3-1 | 0.175 | 0.175 | 17.3 | 0.030 | Cycloheptane | C1-1 | C2-1 | Presence |
| Example 23 | 1-10 | 2-1 | 3-1 | 0.175 | 0.175 | 16.5 | 0.270 | Cyclopentane | C1-1 | C2-1 | Presence |

TABLE 1-continued

| | Formula (1) | Formula (2) | Formula (3) | Formula (2)/ formula (1) (%) | Formula (3)/ formula (1) (%) | HSP value of solvent ($MPa^{1/2}$) | Formula (2)/solvent (%) | Solvent | Charge transport Substance 1 | Charge transport Substance 2 | Before curing Drying |
|---|---|---|---|---|---|---|---|---|---|---|---|
| Example 24 | 1-10 | 2-1 | 3-1 | 0.175 | 0.175 | 16.5 | 0.030 | Cyclopentane | C1-1 | C2-1 | Presence |
| Example 25 | 1-10 | 2-1 | 3-1 | 0.175 | 0.175 | 17.3 | 0.500 | Cycloheptane | C1-1 | C2-1 | Presence |
| Example 26 | 1-10 | 2-1 | 3-1 | 0.175 | 0.175 | 17.3 | 0.005 | Cycloheptane | C1-1 | C2-1 | Presence |
| Example 27 | 1-10 | 2-1 | 3-1 | 0.175 | 0.175 | 16.5 | 0.500 | Cyclopentane | C1-1 | C2-1 | Presence |
| Example 28 | 1-10 | 2-1 | 3-1 | 0.175 | 0.175 | 16.5 | 0.005 | Cyclopentane | C1-1 | C2-1 | Presence |
| Example 29 | 1-10 | 2-1 | 3-1 | 0.175 | 0.175 | 16.6 | 0.270 | Cyclohexane | CTM-1 | CTM-2 | Presence |
| Example 30 | 1-10 | 2-1 | 3-1 | 4.800 | 0.175 | 16.6 | 0.270 | Cyclohexane | CTM-1 | CTM-2 | Presence |
| Example 31 | 1-10 | 2-1 | 3-1 | 0.175 | 4.800 | 16.6 | 0.270 | Cyclohexane | CTM-1 | CTM-2 | Presence |
| Example 32 | 1-10 | 2-1 | 3-1 | 0.003 | 0.175 | 16.6 | 0.270 | Cyclohexane | CTM-1 | CTM-2 | Presence |
| Example 33 | 1-10 | 2-1 | 3-1 | 0.175 | 0.003 | 16.6 | 0.270 | Cyclohexane | CTM-1 | CTM-2 | Presence |
| Example 34 | 1-10 | 2-1 | 3-1 | 0.175 | 0.175 | 17.3 | 0.500 | Cycloheptane | CTM-1 | CTM-2 | Presence |
| Example 35 | 1-10 | 2-1 | 3-1 | 0.175 | 0.175 | 17.3 | 0.005 | Cycloheptane | CTM-1 | CTM-2 | Presence |
| Example 36 | 1-10 | 2-1 | 3-1 | 1.900 | 0.175 | 16.6 | 0.270 | Cyclohexane | C1-1 | C2-1 | Presence |
| Example 37 | 1-10 | 2-1 | 3-1 | 0.175 | 1.900 | 16.6 | 0.270 | Cyclohexane | C1-1 | C2-1 | Presence |
| Example 38 | 1-10 | 2-1 | 3-1 | 0.020 | 0.175 | 16.6 | 0.270 | Cyclohexane | C1-1 | C2-1 | Presence |
| Example 39 | 1-10 | 2-1 | 3-1 | 0.175 | 0.020 | 16.6 | 0.270 | Cyclohexane | C1-1 | C2-1 | Presence |
| Example 40 | 1-10 | 2-1 | 3-1 | 2.100 | 0.175 | 16.6 | 0.270 | Cyclohexane | C1-1 | C2-1 | Presence |
| Example 41 | 1-10 | 2-1 | 3-1 | 0.175 | 2.100 | 16.6 | 0.270 | Cyclohexane | C1-1 | C2-1 | Presence |
| Example 42 | 1-10 | 2-1 | 3-1 | 0.005 | 0.175 | 16.6 | 0.270 | Cyclohexane | C1-1 | C2-1 | Presence |
| Example 43 | 1-10 | 2-1 | 3-1 | 0.175 | 0.005 | 16.6 | 0.270 | Cyclohexane | C1-1 | C2-1 | Presence |
| Example 44 | 1-10 | 2-1 | 3-1 | 0.175 | 0.175 | 16.6 | 0.270 | Cyclohexane | C1-1 | C2-1 | Absence |

TABLE 2

| | Formula (1) | Formula (2) | Formula (3) | Formula (2)/formula (1) (%) | Formula (3)/ formula (1) (%) | HSP value of solvent ($MPa^{1/2}$) | Formula (2)/solvent (%) | Solvent | Charge transport Substance 1 | Charge transport Substance 2 | Before curing Drying |
|---|---|---|---|---|---|---|---|---|---|---|---|
| Comparative Example 1 | A | 2-1 | 3-1 | 0.175 | 0.175 | 16.6 | 0.270 | Cyclohexane | C1-1 | C2-1 | Presence |
| Comparative Example 2 | 1-10 | B | 3-1 | 0.175 | 0.175 | 16.6 | 0.270 | Cyclohexane | C1-1 | C2-1 | Presence |
| Comparative Example 3 | 1-10 | 2-1 | C | 0.175 | 0.175 | 16.6 | 0.270 | Cyclohexane | C1-1 | C2-1 | Presence |
| Comparative Example 4 | 1-10 | 2-1 | 3-1 | 5.100 | 0.175 | 16.6 | 0.270 | Cyclohexane | C1-1 | C2-1 | Presence |
| Comparative Example 5 | 1-10 | 2-1 | 3-1 | 0.175 | 5.100 | 16.6 | 0.270 | Cyclohexane | C1-1 | C2-1 | Presence |
| Comparative Example 6 | 1-10 | Absence | Absence | — | — | 16.6 | — | Cyclohexane | C1-1 | C2-1 | Presence |
| Comparative Example 7 | 1-10 | Absence | 3-1 | — | — | 16.6 | — | Cyclohexane | C1-1 | C2-1 | Presence |
| Comparative Example 8 | 1-10 | 2-1 | Absence | — | — | 16.6 | 0.270 | Cyclohexane | C1-1 | C2-1 | Presence |

<Evaluation>

In evaluating the unevenness of the film thickness of the protective layer, in all of the Examples and Comparative Examples, the photosensitive member proceeding to the next step after leaving for 10 minutes after the coating liquid for the protective layer is coated, and the photosensitive member proceeding to the next step after leaving for 20 minutes, and the photosensitive member proceeding to the next step after leaving for 30 minutes were produced and evaluated. Generally, the unevenness of the film thickness is more likely to occur as the leaving time after the coating of the coating liquid is longer. In consideration of mass productivity, it is preferable that the unevenness of the film thickness does not occur even if the photosensitive member leaves for 10 minutes or more.

A remodeling machine of a laser beam printer (trade name: HP LaserJet Enterprise 600 M603, non-contact development system, printing speed: A4 vertical 60 sheets/minute) manufactured by Hewlett-Packard Company was used as an evaluation machine. The remodeling points are as follows. In order to maintain (regulate) the distance between the electrophotographic photosensitive member and a developing roller (sleeve), a cylindrical spacing member having a width of 4 mm and made of a POM material which can be rotated around a position about 9 mm from upper and lower ends of the cylinder on which the electrophotographic photosensitive member is formed abuts against the electrophotographic photosensitive member. An abutting force was 2300 gf at both the upper end and the lower end of the photosensitive member. An image formation area using this remodeling machine was from about 20 mm position from the upper end to about 20 mm position from the lower end of the cylinder.

A halftone image was output under the environment of temperature 25° C. and humidity 50% RH using the remodeling machine, and the unevenness of the film thickness was evaluated by visually evaluating the image unevenness of the output image. Evaluation criteria of the unevenness of the film thickness are as follows.

A: Uniform image without image unevenness

B: Image in which a slight unevenness of a drum pitch can be confirmed

C: Image in which the unevenness of the drum pitch can be confirmed

Thereafter, the image formation of 100,000 sheets was performed by an intermittent mode which stops every time when an image of printing ratio 1% is formed on 2 sheets with plain paper of A4 size under the environment that a temperature is 5° C. and a humidity is 10% RH.

The scraped amount of the electrophotographic photosensitive member after the durability test was measured to evaluate the abrasion resistance. An eddy current film thickness meter PERMASCOPE TYPE E111 (manufactured by Fischer) was used for the measurement of the scraped amount.

In addition, the paper-passing durability test was performed in an intermittent mode in which the printing was stopped once every print.

The evaluation results are shown in Table 3 and Table 4.

TABLE 3

| | Unevenness of film thickness | | | Abrasion resistance |
|---|---|---|---|---|
| | Leave for 10 minutes | Leave for 20 minutes | Leave for 30 minutes | 100,000 sheets of scraped amount (μm) |
| Example 1 | A | A | A | 0.3 |
| Example 2 | A | A | A | 0.5 |
| Example 3 | A | A | A | 0.5 |
| Example 4 | A | A | B | 0.3 |
| Example 5 | A | A | B | 0.3 |
| Example 6 | A | A | A | 0.3 |
| Example 7 | A | A | A | 0.3 |
| Example 8 | A | A | A | 0.3 |
| Example 9 | A | A | B | 0.5 |
| Example 10 | A | B | B | 0.3 |
| Example 11 | A | A | B | 0.5 |
| Example 12 | A | B | B | 0.3 |
| Example 13 | A | A | B | 0.7 |
| Example 14 | B | B | B | 0.3 |
| Example 15 | A | A | B | 0.7 |
| Example 16 | B | B | B | 0.3 |
| Example 17 | B | B | B | 0.7 |
| Example 18 | B | B | B | 0.3 |
| Example 19 | B | B | B | 0.7 |
| Example 20 | B | B | B | 0.7 |
| Example 21 | A | A | A | 0.5 |
| Example 22 | A | A | A | 0.3 |
| Example 23 | A | A | A | 0.5 |
| Example 24 | A | A | A | 0.3 |
| Example 25 | A | A | A | 0.7 |
| Example 26 | A | A | B | 0.3 |
| Example 27 | A | A | A | 0.7 |
| Example 28 | A | A | B | 0.3 |
| Example 29 | A | B | B | 0.3 |
| Example 30 | A | A | B | 0.5 |
| Example 31 | A | A | B | 0.5 |
| Example 32 | A | B | B | 0.3 |
| Example 33 | A | B | B | 0.3 |
| Example 34 | A | B | B | 0.7 |
| Example 35 | B | B | B | 0.3 |
| Example 36 | A | A | A | 0.4 |
| Example 37 | A | A | A | 0.4 |
| Example 38 | A | A | A | 0.3 |
| Example 39 | A | A | A | 0.3 |
| Example 40 | A | A | A | 0.5 |
| Example 41 | A | A | A | 0.5 |
| Example 42 | A | A | B | 0.3 |
| Example 43 | A | A | B | 0.3 |
| Example 44 | A | B | B | 0.3 |

TABLE 4

| | Unevenness of film thickness | | | Abrasion resistance |
|---|---|---|---|---|
| | Leave for 10 minutes | Leave for 20 minutes | Leave for 30 minutes | 100,000 sheets of scraped amount (μm) |
| Comparative Example 1 | C | C | C | 0.5 |
| Comparative Example 2 | C | C | C | 0.5 |
| Comparative Example 3 | C | C | C | 0.5 |
| Comparative Example 4 | B | C | C | 1.2 |
| Comparative Example 5 | B | C | C | 1.2 |
| Comparative Example 6 | C | C | C | 1.2 |
| Comparative Example 7 | C | C | C | 1.2 |
| Comparative Example 8 | C | C | C | 1.2 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-105585, filed May 31, 2018, which is hereby incorporated by reference herein in its entirety.

What is claimed is:

1. A method for producing an electrophotographic photosensitive member including a photosensitive layer and a protective layer above an electro-conductive support in this order, the method comprising the steps of:

forming a coating film for a protective layer by coating a coating liquid on the photosensitive layer; and curing the coating film, wherein the coating liquid contains a solvent, a compound represented by formula (1), a compound represented by formula (2), and a compound represented by formula (3)

where the compound represented by formula (1) is any of formulae (1-1) to (1-21)

1-1

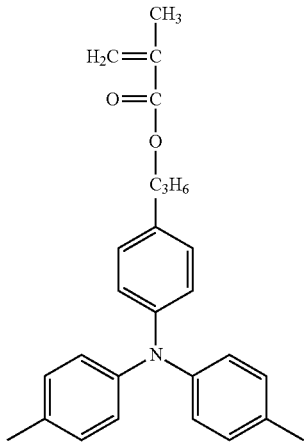

-continued
1-2
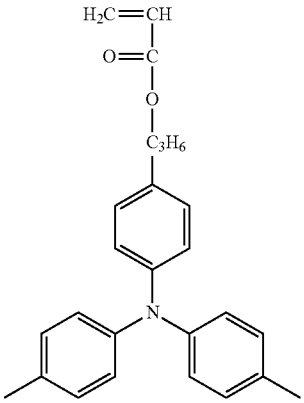
1-3
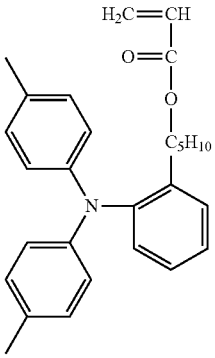
1-4
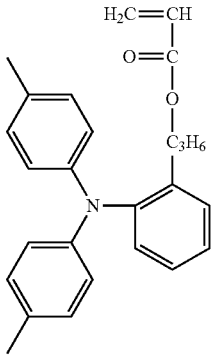
1-5
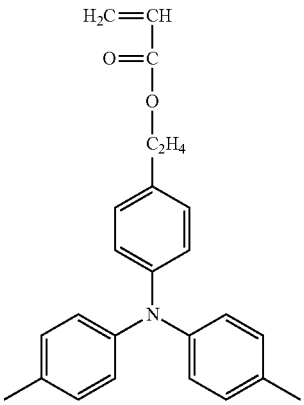
-continued
1-6
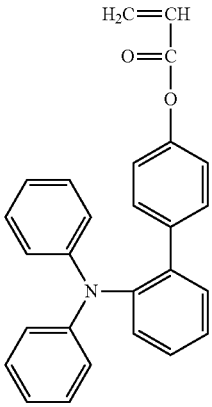
1-7
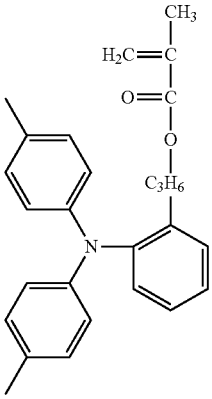
1-8
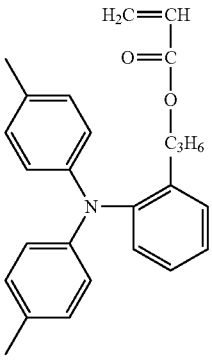
1-9
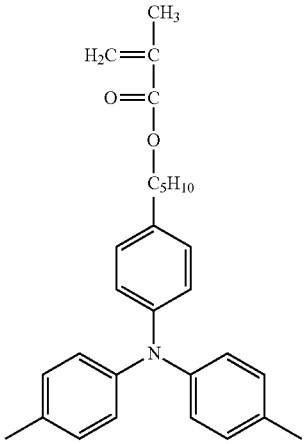

-continued
1-10
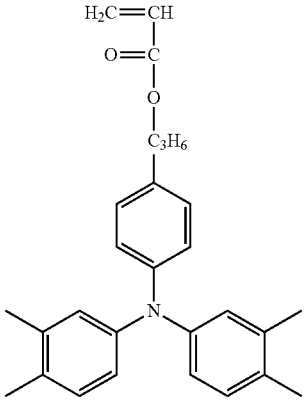
1-11
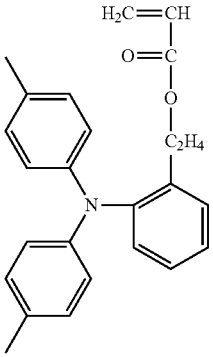
1-12
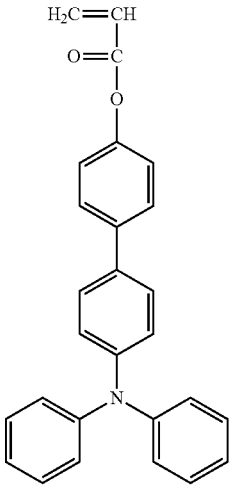
1-13
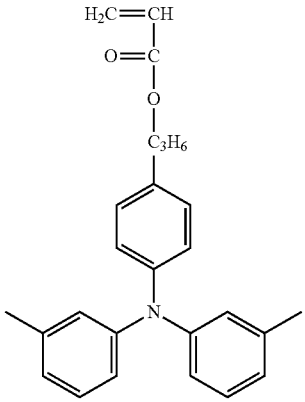
-continued
1-14
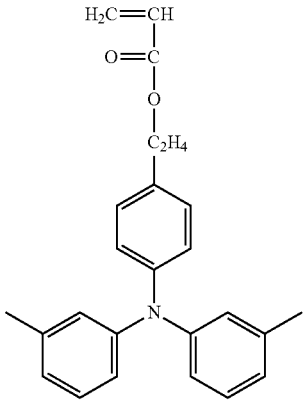
1-15
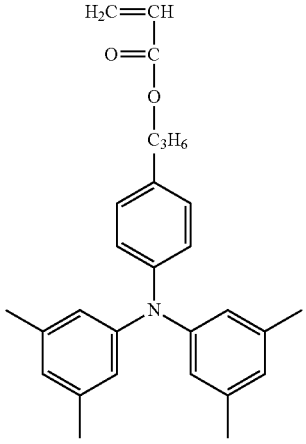
1-16
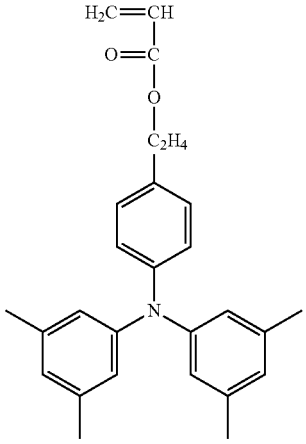

-continued
1-17
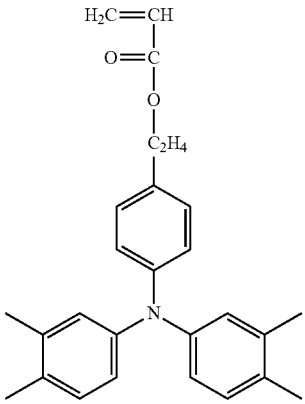
1-18
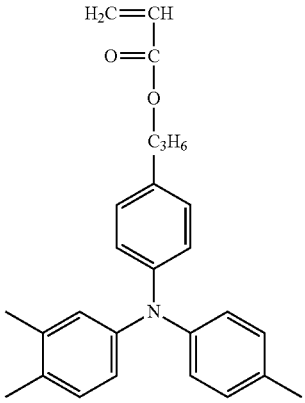
1-19
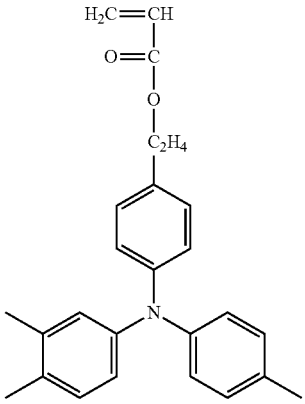
1-20
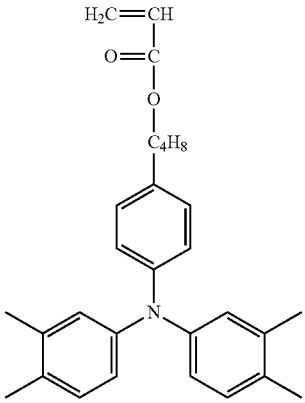
-continued
1-21
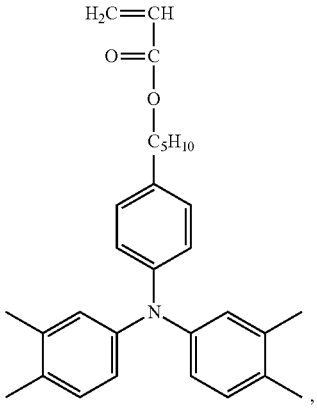
(2)
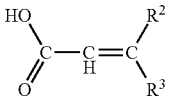
where $R^2$ and $R^3$ represent independently a hydrogen atom or a methyl group, and where the compound represented by formula (3) is any of formulae (3-1) to (3-12)
3-1
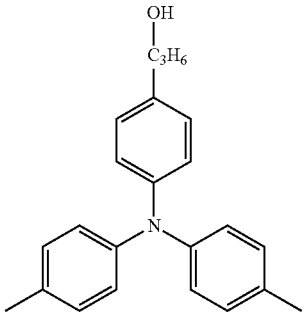
3-2
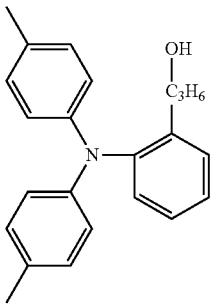

-continued
3-3
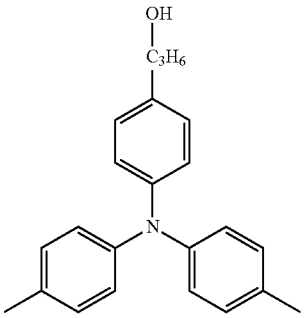
3-4
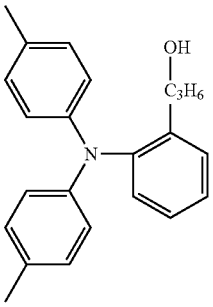
3-5
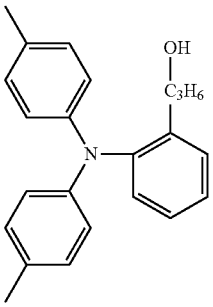
3-6
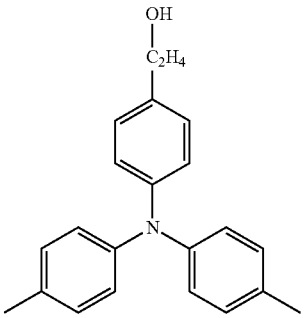
3-7
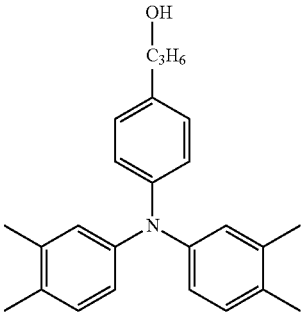
-continued
3-8
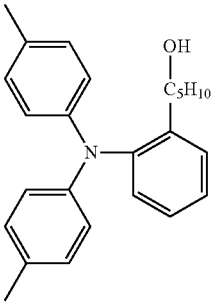
3-9
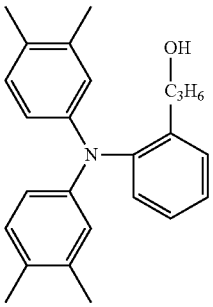
3-10
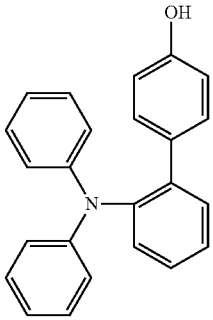
3-11
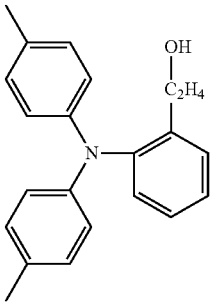

-continued 3-12

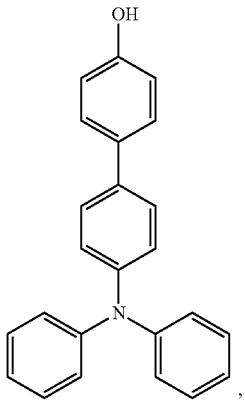

and a content of the compound represented by formula (2) is 0.001 to 5.0 mass %, and a content of the compound represented by formula (3) is 0.001 to 5.0 mass % with respect to a content of the compound represented by formula (1).

2. The method for producing an electrophotographic photosensitive member according to claim 1, wherein the solvent has an HSP value of 14.5 to 18.5 $MPa^{1/2}$, and a ratio of the compound represented by formula (2) with respect to the solvent is 0.01 to 0.30 mass %.

3. The method for producing an electrophotographic photosensitive member according to claim 1, wherein the solvent is an alicyclic alkyl.

4. The method for producing an electrophotographic photosensitive member according to claim 1, wherein the photosensitive layer has a charge transporting substance represented by formula (C1) or a charge transporting substance represented by formula (C2)

(C1)

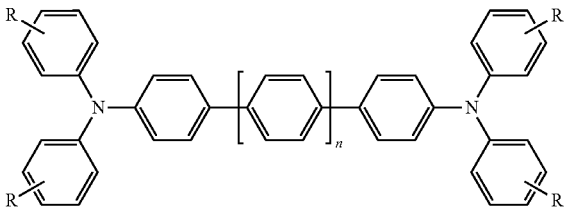

(C2)

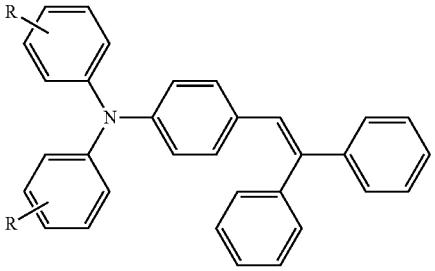

where n is 0, 1, or 2 and R represents a hydrogen atom or a methyl group.

5. The method for producing an electrophotographic photosensitive member according to claim 1, wherein the content of the compound represented by formula (2) is 0.010 to 2.0 mass % with respect to the content of the compound represented by formula (1), and the content of the compound represented by formula (3) is 0.010 to 2.0 mass % with respect to the content of the compound represented by formula (1).

6. The method for producing an electrophotographic photosensitive member according to claim 1, further comprising:

drying volatilizing the solvent between the steps of forming the coating film for the protective layer and curing the coating film for the protective layer.

7. An electrophotographic photosensitive member, comprising:

a photosensitive layer and a protective layer above an electro-conductive support in this order;

the protective layer being a film obtained by curing a coating film, the coating liquid containing a solvent, a compound represented by formula (1), a compound represented by formula (2), and a compound represented by formula (3)

where the compound represented by formula (1) is any of formulae (1-1) to (1-21)

1-1

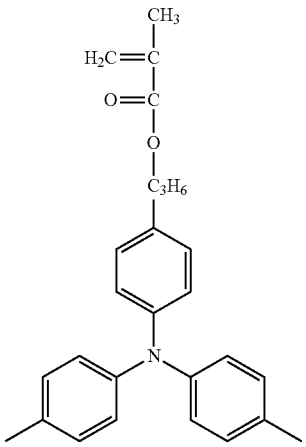

1-2

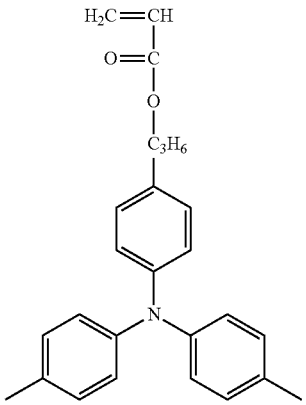

-continued
1-3
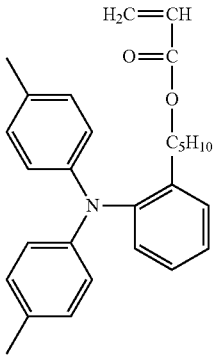
1-4
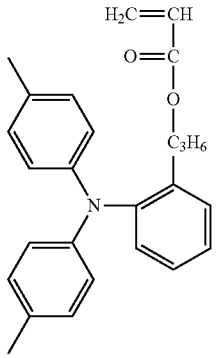
1-5
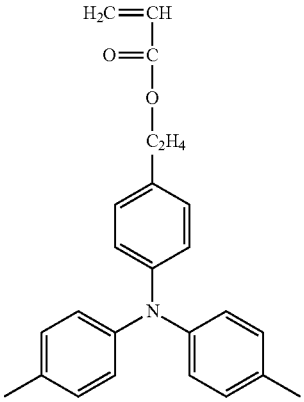
1-6
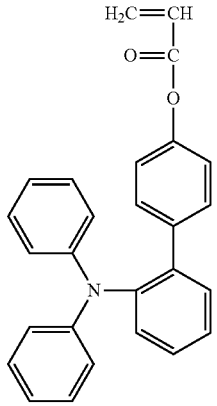
-continued
1-7
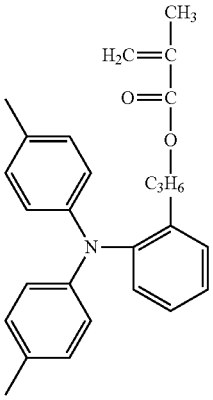
1-8
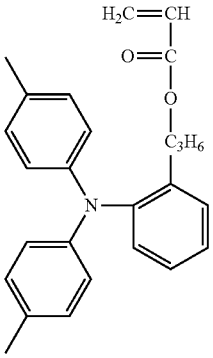
1-9
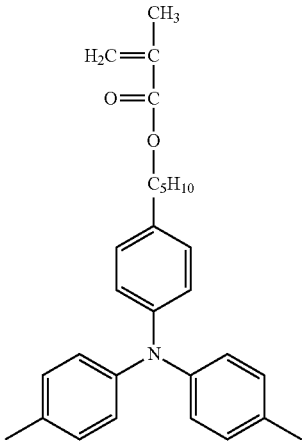
1-10
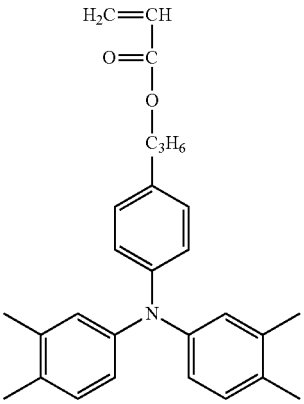

-continued
1-11
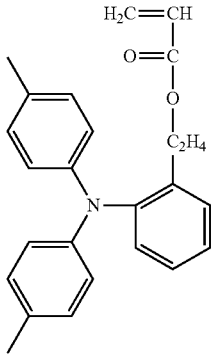
1-12
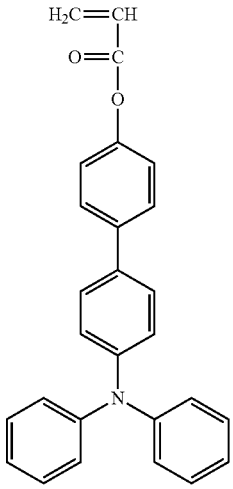
1-13
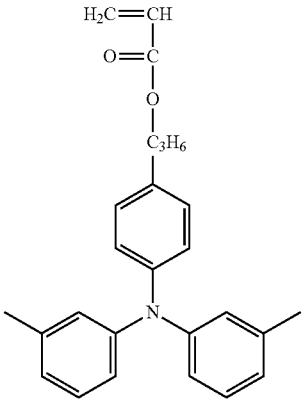
1-14
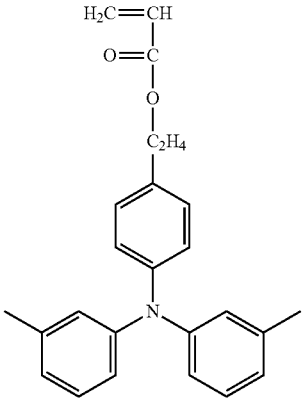
-continued
1-15
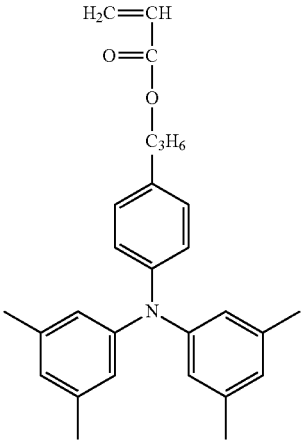
1-16
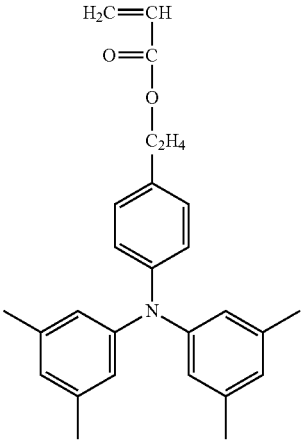
1-17
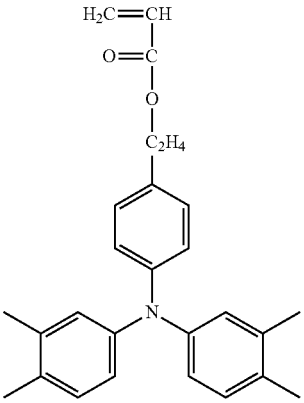

-continued
1-18
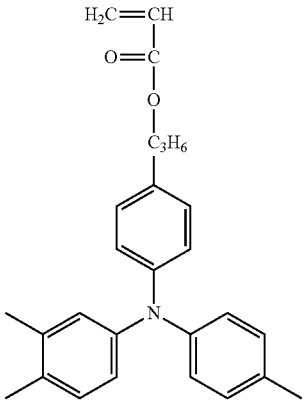
1-19
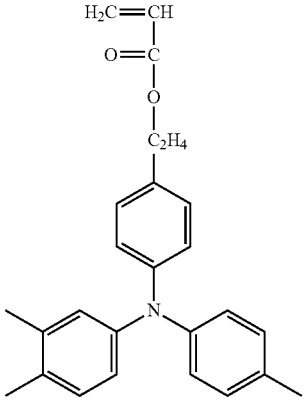
1-20
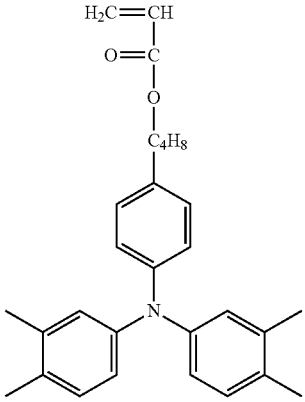
1-21
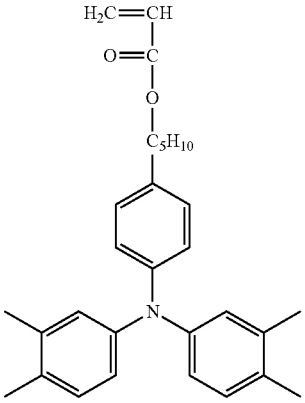
,
-continued
(2)
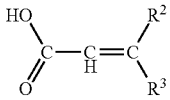
where $R^2$ and $R^3$ represent independently a hydrogen atom or a methyl group, and
where the compound represented by formula (3) is any of formulae (3-1) to (3-12)
3-1
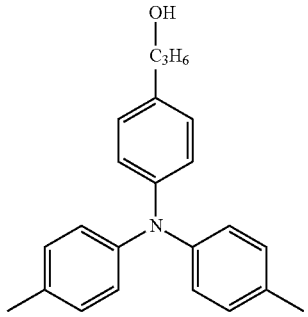
3-2
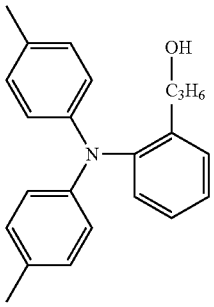
3-3
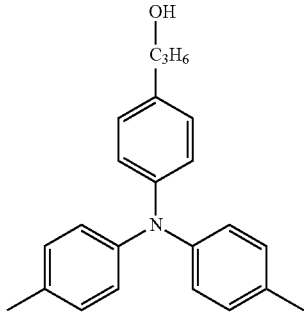
3-4
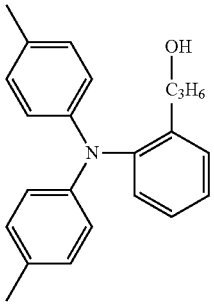

-continued
3-5
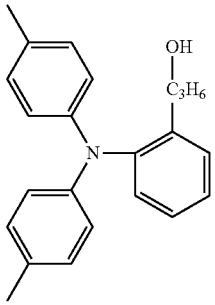
3-6
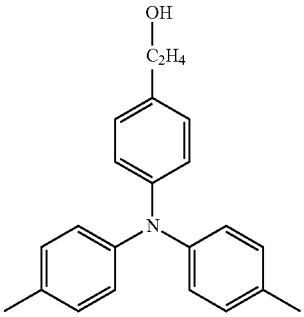
3-7
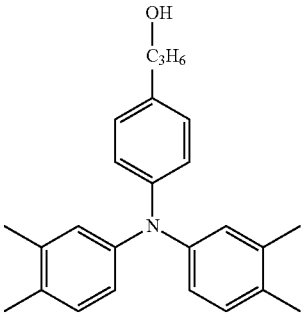
3-8
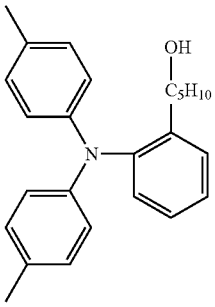
-continued
3-9
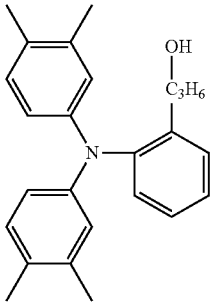
3-10
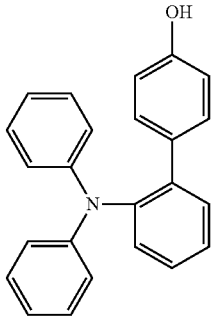
3-11
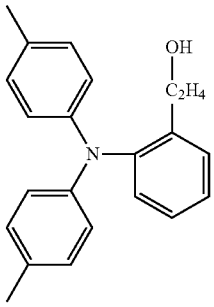
3-12
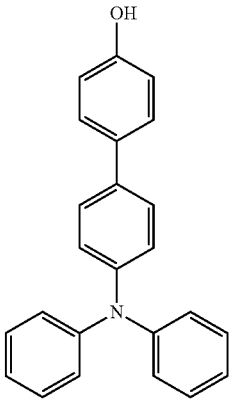
,
wherein
a content of the compound represented by formula (2) is 0.001 to 5.0 mass %, and a content of the compound represented by formula (3) is 0.001 to 5.0 mass % with respect to a content of the compound represented by formula (1).
* * * * *